US010475417B2

(12) United States Patent
Jiang et al.

(10) Patent No.: US 10,475,417 B2
(45) Date of Patent: Nov. 12, 2019

(54) HISTORY-AWARE SELECTIVE PIXEL SHIFTING

(71) Applicant: INTEL CORPORATION, Santa Clara, CA (US)

(72) Inventors: Jun Jiang, Portland, OR (US); Zhiming J. Zhuang, Sammamish, WA (US); Srikanth Kambhatla, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 57 days.

(21) Appl. No.: 15/473,548

(22) Filed: Mar. 29, 2017

(65) Prior Publication Data

US 2018/0286356 A1 Oct. 4, 2018

(51) Int. Cl.

| | |
|---|---|
| ***G09G 5/36*** | (2006.01) |
| ***G09G 5/02*** | (2006.01) |
| ***G09G 3/00*** | (2006.01) |

(52) U.S. Cl.

CPC ..... *G09G 5/36* (2013.01); *G09G 3/007* (2013.01); *G09G 5/02* (2013.01); *G09G 2320/043* (2013.01); *G09G 2320/046* (2013.01)

(58) Field of Classification Search

CPC ..... G09G 3/3233; G09G 2320/0233; G09G 3/3208; G09G 2320/029; G09G 2320/043; G09G 2320/048; G09G 2320/0295; G09G 2320/046; G09G 3/007

See application file for complete search history.

(56) References Cited

U.S. PATENT DOCUMENTS

| | | | | |
|---|---|---|---|---|
| 9,454,925 | B1 * | 9/2016 | Grafton | G09G 3/2007 |
| 2004/0252135 | A1 * | 12/2004 | Ono | G09G 3/007 345/619 |
| 2007/0109284 | A1 * | 5/2007 | Yamazaki | G09G 3/20 345/204 |
| 2017/0221455 | A1 * | 8/2017 | Lee | G06T 3/20 |

* cited by examiner

*Primary Examiner* — Xiao M Wu
*Assistant Examiner* — Scott E Sonners

(57) ABSTRACT

Techniques for generating pixel shifting patterns for organic light emitting diode (OLED) displays are provided. Pixel usage data for the OLED display can be accumulated. Areas of the OLED display susceptible to burn-in damage can be identified based on the accumulated pixel usage data. A pixel shifting pattern can be generated based on the accumulated pixel image data and data relating to an image to be displayed. The pixel shifting pattern can be generated to avoid the areas identified as susceptible to burn-in damage. The pixel shifting pattern can be applied to the image to be displayed to generate modified image data. The modified image data can limit further damage to the OLED display and thereby delay the onset of undesirable burn-in effects.

12 Claims, 17 Drawing Sheets

*FIG. 3*

*300*

302 304 306 308

| Step# | Center Point, X | Center Point, Y | time, 1/FrameRate |
|---|---|---|---|
| 0 | 0 | 0 | 1 |
| 1 | 0 | -1 | 1 |
| 2 | 1 | -1 | 1 |
| 3 | 1 | -2 | 1 |
| 4 | 2 | -2 | 1 |
| 5 | 2 | -3 | 1 |
| 6 | 3 | -3 | 1 |
| 7 | 4 | -3 | 1 |
| 8 | 4 | -2 | 1 |
| 9 | 5 | -2 | 1 |
| 10 | 5 | -1 | 1 |
| 11 | 6 | -1 | 1 |
| 12 | 6 | 0 | 1 |
| 13 | 7 | 0 | 1 |
| 14 | 7 | 1 | 1 |
| 15 | 8 | 1 | 1 |
| 16 | 8 | 2 | 1 |
| 17 | 9 | 2 | 1 |
| 18 | 9 | 3 | 1 |
| 19 | 9 | 4 | 1 |
| 20 | 8 | 4 | 1 |

*FIG. 4*

302 304 306 308 402

| Step# | Center Point, X | Center Point, Y | time, 1/frameRate | time weighted factor |
|---|---|---|---|---|
| 0 | 0 | 0 | 1 | a0 |
| 1 | 0 | -1 | 1 | a1 |
| 2 | 1 | -1 | 1 | a2 |
| 3 | 1 | -2 | 1 | a3 |
| 4 | 2 | -2 | 1 | a4 |
| 5 | 2 | -3 | 1 | a5 |
| 6 | 3 | -3 | 1 | a6 |
| 7 | 4 | -3 | 1 | a7 |
| 8 | 4 | -2 | 1 | a8 |
| 9 | 5 | -2 | 1 | a9 |
| 10 | 5 | -1 | 1 | a10 |
| 11 | 6 | -1 | 1 | a11 |
| 12 | 6 | 0 | 1 | a12 |
| 13 | 7 | 0 | 1 | a13 |
| 14 | 7 | 1 | 1 | a14 |
| 15 | 8 | 1 | 1 | a15 |
| 16 | 8 | 2 | 1 | a16 |
| 17 | 9 | 2 | 1 | a17 |
| 18 | 9 | 3 | 1 | a18 |
| 19 | 9 | 4 | 1 | a19 |
| 20 | 8 | 4 | 1 | a20 |

*FIG. 7A*

*700*

*712* *714* *716* *702* *718* *704*

*710*

| Orbit1 | | | | | Orbit2 | | | | |
|---|---|---|---|---|---|---|---|---|---|
| Step# | Center Point, X | Center Point, Y | time, 1/FrameRate | time weighted factor | Step# | Center Point, X | Center Point, Y | time, 1/FrameRate | time weighted factor |
| 0 | 0 | 0 | 1 | 1 | 48 | 0 | 0 | 1 | 1 |
| 1 | 0 | -1 | 1 | 2 | 49 | 1 | 0 | 1 | 2 |
| 2 | 1 | -1 | 1 | 3 | 50 | 1 | -1 | 1 | 3 |
| 3 | 1 | -2 | 1 | 4 | 51 | 2 | -1 | 1 | 4 |
| 4 | 2 | -2 | 1 | 5 | 52 | 2 | -2 | 1 | 5 |
| 5 | 2 | -3 | 1 | 6 | 53 | 3 | -2 | 1 | 6 |
| 6 | 3 | -3 | 1 | 7 | 54 | 3 | -3 | 1 | 7 |
| 7 | 4 | -3 | 1 | 8 | 55 | 3 | -4 | 1 | 8 |
| 8 | 4 | -2 | 1 | 9 | 56 | 2 | -4 | 1 | 9 |
| 9 | 5 | -2 | 1 | 10 | 57 | 2 | -5 | 1 | 10 |
| 10 | 5 | -1 | 1 | 11 | 58 | 1 | -5 | 1 | 11 |
| 11 | 6 | -1 | 1 | 12 | 59 | 1 | -6 | 1 | 12 |
| 12 | 6 | 0 | 1 | 13 | 60 | 0 | -6 | 1 | 13 |
| 13 | 7 | 0 | 1 | 14 | 61 | 0 | -7 | 1 | 14 |
| 14 | 7 | 1 | 1 | 15 | 62 | -1 | -7 | 1 | 15 |
| 15 | 8 | 1 | 1 | 16 | 63 | -1 | -8 | 1 | 16 |
| 16 | 8 | 2 | 1 | 17 | 64 | -2 | -8 | 1 | 17 |
| 17 | 9 | 2 | 1 | 18 | 65 | -2 | -9 | 1 | 18 |
| 18 | 9 | 3 | 1 | 19 | 66 | -3 | -9 | 1 | 19 |
| 19 | 9 | 4 | 1 | 20 | 67 | -4 | -9 | 1 | 20 |
| 20 | 8 | 4 | 1 | 21 | 68 | -4 | -8 | 1 | 21 |
| 21 | 8 | 5 | 1 | 22 | 69 | -5 | -8 | 1 | 22 |
| 22 | 7 | 5 | 1 | 23 | 70 | -5 | -7 | 1 | 23 |
| 23 | 7 | 6 | 1 | 24 | 71 | -6 | -7 | 1 | 24 |
| 24 | 6 | 6 | 1 | 25 | 72 | -6 | -6 | 1 | 25 |
| 25 | 6 | 7 | 1 | 24 | 73 | -7 | -6 | 1 | 24 |
| 26 | 5 | 7 | 1 | 23 | 74 | -7 | -5 | 1 | 23 |
| 27 | 5 | 8 | 1 | 22 | 75 | -8 | -5 | 1 | 22 |
| 28 | 4 | 8 | 1 | 21 | 76 | -8 | -4 | 1 | 21 |
| 29 | 4 | 9 | 1 | 20 | 77 | -9 | -4 | 1 | 20 |
| 30 | 3 | 9 | 1 | 19 | 78 | -9 | -3 | 1 | 19 |
| 31 | 2 | 9 | 1 | 18 | 79 | -9 | -2 | 1 | 18 |
| 32 | 2 | 8 | 1 | 17 | 80 | -8 | -2 | 1 | 17 |
| 33 | 1 | 8 | 1 | 16 | 81 | -8 | -1 | 1 | 16 |
| 34 | 1 | 7 | 1 | 15 | 82 | -7 | -1 | 1 | 15 |
| 35 | 0 | 7 | 1 | 14 | 83 | -7 | 0 | 1 | 14 |
| 36 | 0 | 6 | 1 | 13 | 84 | -6 | 0 | 1 | 13 |
| 37 | -1 | 6 | 1 | 12 | 85 | -6 | 1 | 1 | 12 |
| 38 | -1 | 5 | 1 | 11 | 86 | -5 | 1 | 1 | 11 |
| 39 | -2 | 5 | 1 | 10 | 87 | -5 | 2 | 1 | 10 |
| 40 | -2 | 4 | 1 | 9 | 88 | -4 | 2 | 1 | 9 |
| 41 | -3 | 4 | 1 | 8 | 89 | -4 | 3 | 1 | 8 |
| 42 | -3 | 3 | 1 | 7 | 90 | -3 | 3 | 1 | 7 |
| 43 | -3 | 2 | 1 | 6 | 91 | -2 | 3 | 1 | 6 |
| 44 | -2 | 2 | 1 | 5 | 92 | -2 | 2 | 1 | 5 |
| 45 | -2 | 1 | 1 | 4 | 93 | -1 | 2 | 1 | 4 |
| 46 | -1 | 1 | 1 | 3 | 94 | -1 | 1 | 1 | 3 |
| 47 | -1 | 0 | 1 | 2 | 95 | 0 | 1 | 1 | 2 |

*FIG. 7B*

706 708

| Orbit3 | | | | | Orbit4 | | | | |
|---|---|---|---|---|---|---|---|---|---|
| Step# | Center Point, X | Center Point, Y | time, 1/FrameRate | time weighted factor | Step# | Center Point, X | Center Point, Y | time, 1/FrameRate | time weighted factor |
| 98 | 0 | 0 | 1 | 1 | 144 | 0 | 0 | 1 | 1 |
| 97 | 0 | -1 | 1 | 2 | 145 | -1 | -1 | 1 | 2 |
| 98 | -1 | -1 | 1 | 3 | 146 | -1 | -1 | 1 | 3 |
| 99 | -1 | -2 | 1 | 4 | 147 | -2 | -2 | 1 | 4 |
| 100 | -2 | -2 | 1 | 5 | 148 | -2 | -2 | 1 | 5 |
| 101 | -2 | -3 | 1 | 6 | 149 | -3 | -3 | 1 | 6 |
| 102 | -3 | -3 | 1 | 7 | 150 | -3 | -3 | 1 | 7 |
| 103 | -4 | -3 | 1 | 8 | 151 | -3 | -3 | 1 | 8 |
| 104 | -4 | -2 | 1 | 9 | 152 | -2 | -2 | 1 | 9 |
| 105 | -5 | -2 | 1 | 10 | 153 | -2 | -2 | 1 | 10 |
| 106 | -5 | -1 | 1 | 11 | 154 | -1 | -1 | 1 | 11 |
| 107 | -6 | -1 | 1 | 12 | 155 | -1 | -1 | 1 | 12 |
| 108 | -6 | 0 | 1 | 13 | 156 | 0 | 0 | 1 | 13 |
| 109 | -7 | 0 | 1 | 14 | 157 | 0 | 0 | 1 | 14 |
| 110 | -7 | 1 | 1 | 15 | 158 | 1 | 1 | 1 | 15 |
| 111 | -8 | 1 | 1 | 16 | 159 | 1 | 1 | 1 | 16 |
| 112 | -8 | 2 | 1 | 17 | 160 | 2 | 2 | 1 | 17 |
| 113 | -9 | 2 | 1 | 18 | 161 | 2 | 2 | 1 | 18 |
| 114 | -9 | 3 | 1 | 19 | 162 | 3 | 3 | 1 | 19 |
| 115 | -9 | 4 | 1 | 20 | 163 | 4 | 4 | 1 | 20 |
| 116 | -8 | 4 | 1 | 21 | 164 | 4 | 4 | 1 | 21 |
| 117 | -8 | 5 | 1 | 22 | 165 | 5 | 5 | 1 | 22 |
| 118 | -7 | 5 | 1 | 23 | 166 | 5 | 5 | 1 | 23 |
| 119 | -7 | 6 | 1 | 24 | 167 | 6 | 6 | 1 | 24 |
| 120 | -6 | 6 | 1 | 25 | 168 | 6 | 6 | 1 | 25 |
| 121 | -6 | 7 | 1 | 24 | 169 | 7 | 7 | 1 | 24 |
| 122 | -5 | 7 | 1 | 23 | 170 | 7 | 7 | 1 | 23 |
| 123 | -5 | 8 | 1 | 22 | 171 | 8 | 8 | 1 | 22 |
| 124 | -4 | 8 | 1 | 21 | 172 | 8 | 8 | 1 | 21 |
| 125 | -4 | 9 | 1 | 20 | 173 | 9 | 9 | 1 | 20 |
| 126 | -3 | 9 | 1 | 19 | 174 | 9 | 9 | 1 | 19 |
| 127 | -2 | 9 | 1 | 18 | 175 | 9 | 9 | 1 | 18 |
| 128 | -2 | 8 | 1 | 17 | 176 | 8 | 8 | 1 | 17 |
| 129 | -1 | 8 | 1 | 16 | 177 | 8 | 8 | 1 | 16 |
| 130 | -1 | 7 | 1 | 15 | 178 | 7 | 7 | 1 | 15 |
| 131 | 0 | 7 | 1 | 14 | 179 | 7 | 7 | 1 | 14 |
| 132 | 0 | 6 | 1 | 13 | 180 | 6 | 6 | 1 | 13 |
| 133 | 1 | 6 | 1 | 12 | 181 | 6 | 6 | 1 | 12 |
| 134 | 1 | 5 | 1 | 11 | 182 | 5 | 5 | 1 | 11 |
| 135 | 2 | 5 | 1 | 10 | 183 | 5 | 5 | 1 | 10 |
| 136 | 2 | 4 | 1 | 9 | 184 | 4 | 4 | 1 | 9 |
| 137 | 3 | 4 | 1 | 8 | 185 | 4 | 4 | 1 | 8 |
| 138 | 3 | 3 | 1 | 7 | 186 | 3 | 3 | 1 | 7 |
| 139 | 3 | 2 | 1 | 6 | 187 | 2 | 2 | 1 | 6 |
| 140 | 2 | 2 | 1 | 5 | 188 | 2 | 2 | 1 | 5 |
| 141 | 2 | 1 | 1 | 4 | 189 | 1 | 1 | 1 | 4 |
| 142 | 1 | 1 | 1 | 3 | 190 | 1 | 1 | 1 | 3 |
| 143 | 1 | 0 | 1 | 2 | 191 | 0 | 0 | 1 | 2 |

HISTORY-AWARE SELECTIVE PIXEL SHIFTING

BACKGROUND

Organic light emitting diode (OLED) displays can experience uneven degradation due to variations in displayed content. Differences between the degradation rates for pixels of the OLED display can lead to undesirable effects such as color shift or burn-in. Compensation techniques can be applied to OLEDs to prolong the useful life of an OLED display by mitigating these undesirable effects. However, once introduced, these compensation techniques must thereafter always be used. Further, the compensation techniques significantly increase power consumption requirements. Accordingly, new techniques for displaying images on an OLED display to delay the onset of burn-in and other undesirable effects may be needed.

BRIEF DESCRIPTION OF THE DRAWINGS

FIG. 3 illustrates a portion of a first exemplary pixel shifting pattern.

FIG. 4 illustrates a portion of a second exemplary pixel shifting pattern.

FIGS. 7A-B illustrates a portion of a third exemplary pixel shifting pattern.

DETAILED DESCRIPTION

Figure 1:
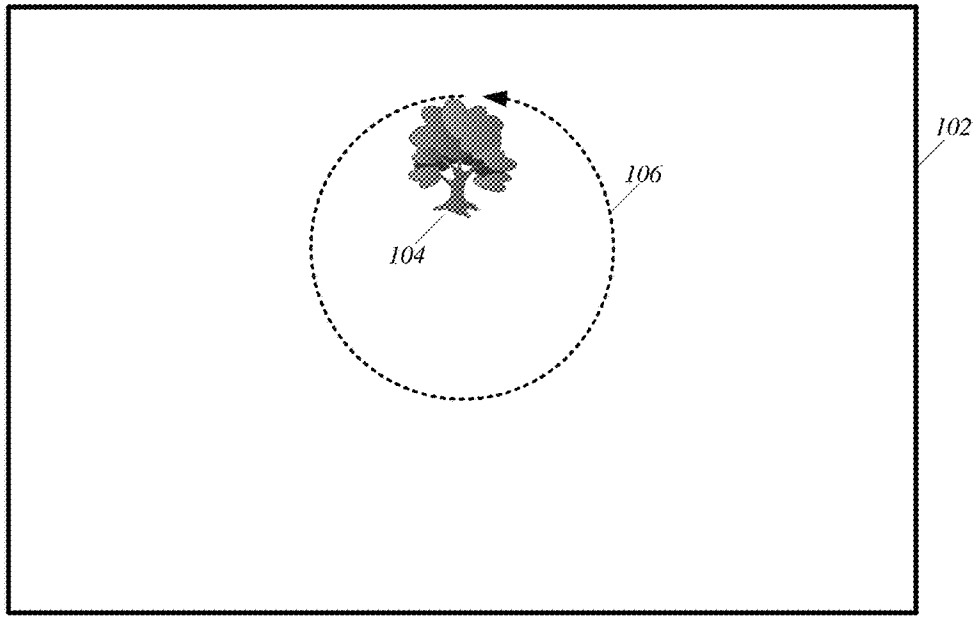
FIG. 1 illustrates a first pixel shifting scheme.

Various embodiments may be generally directed to techniques for generating pixel shifting patterns for organic light emitting diode (OLED) displays. Pixel usage data for the OLED display can be accumulated. Areas of the OLED display susceptible to burn-in damage can be identified based on the accumulated pixel usage data. A pixel shifting pattern can be generated based on the accumulated pixel image data and data relating to an image to be displayed. The pixel shifting pattern can be generated to avoid the areas identified as susceptible to burn-in damage. The pixel shifting pattern can be applied to the image to be displayed to generate modified image data. The modified image data can limit further damage to the OLED display and thereby delay the onset of undesirable burn-in effects.

Degradation in OLED displays can be characterized by the loss of luminance over time. The rate of this degradation can be different for each pixel since the large number of pixels used to form the display can be used unevenly based on the displayed content. Differences in the degradation rates for the pixels can accumulate over time and can lead to undesirable effects such as color shift or burn-in. These undesirable effects have prevented the wide adoption of OLEDs for computer displays.

Compensation techniques can be applied to OLEDs to prolong the useful life of an OLED display by mitigating the burn-in effect. These compensation techniques typically depend on knowledge of the content history displayed by the OLED display over time. Compensation techniques can visually reduce the effects of burn-in. However, many compensation techniques are computationally intensive and thereby cause a significant increase in power consumption. Further, once compensation techniques are implemented, the techniques must be continuously used to prevent any visual artifacts from showing up again. Therefore, it is desirable to delay the onset of burn-in in OLED displays and the introduction of compensation techniques for as long as possible to limit increased power compensation and the need to thereafter always use compensation techniques.

By introducing some kind of dithering in pixel position on the display, burn-in can be delayed. As an example, the displayed image on a screen can be translated one pixel at a time following specific patterns to implement pixel shifting. Different display manufacturers may choose different patterns for such pixel shifting.

Conventional pixel shifting methods generally apply a universal pixel shifting scheme to the display area as a whole in an attempt to evenly distribute the potential damage to extended neighboring areas over time. However, in practice, evenly distributing the potential damage is unlikely to result due to (1) uneven usage of pixels (e.g., for certain user interfaces (UIs)) and/or (2) the high likelihood that each pixel shifting step may not get even coverage due to unexpected events such as interruption of the system.

Various embodiments described herein provide pixel shifting techniques that can can delay the onset of pixel damage without introducing significant increases to power consumption. By implementing the pixel shifting techniques described herein, the onset of pixel burn-in can be delayed. Various embodiments provide pixel shifting techniques based on history awareness of prior usage so as to achieve optimal burn-in avoidance and to delay the need for compensation for any self-emitting display devices (e.g., an OLED display).

Various embodiments described herein provide pixel shifting techniques that: (a) introduce time dynamism into the pixel shifting schemes/patterns by supplementing a series of steps with time weighted factors; (b) use history-aware selective/partial pixel shifting algorithms that use the accumulated pixel usage history to guide the choice of the pixel shifting algorithm achieving space dynamism; and/or (c) allow for a per-region pixel shifting algorithm targeting concurrent use of different pixel shifting algorithms in different regions of the same display—with each algorithm being generated based on pixel usage history. By analyzing the accumulated pixel usage data, the areas with more extensive burn-in damage can be identified, thereby enabling dynamic changes to the pixel shifting pattern to avoid these regions. Further, by dividing the whole screen area into multiple region based on pixel usage characteristics, each region can be addressed with a different pixel shifting scheme to achieve better damage avoidance results.

With general reference to notations and nomenclature used herein, one or more portions of the detailed description which follows may be presented in terms of program procedures executed on a computer or network of computers. These procedural descriptions and representations are used by those skilled in the art to most effectively convey the substances of their work to others skilled in the art. A procedure is here, and generally, conceived to be a self-consistent sequence of operations leading to a desired result. These operations are those requiring physical manipulations of physical quantities. Usually, though not necessarily, these quantities take the form of electrical, magnetic, or optical signals capable of being stored, transferred, combined, compared, and otherwise manipulated. It proves convenient at times, principally for reasons of common usage, to refer to these signals as bits, values, elements, symbols, characters, terms, numbers, or the like. It should be noted, however, that all of these and similar terms are to be associated with the appropriate physical quantities and are merely convenient labels applied to those quantities.

Further, these manipulations are often referred to in terms, such as adding or comparing, which are commonly associated with mental operations performed by a human operator. However, no such capability of a human operator is necessary, or desirable in most cases, in any of the operations described herein that form part of one or more embodiments. Rather, these operations are machine operations. Useful machines for performing operations of various embodiments include general purpose digital computers as selectively activated or configured by a computer program stored within that is written in accordance with the teachings herein, and/or include apparatus specially constructed for the required purpose. Various embodiments also relate to apparatus or systems for performing these operations. These apparatuses may be specially constructed for the required purpose or may include a general-purpose computer. The required structure for a variety of these machines will be apparent from the description given.

Reference is now made to the drawings, wherein like reference numerals are used to refer to like elements throughout. In the following description, for purpose of explanation, numerous specific details are set forth in order to provide a thorough understanding thereof. It may be evident, however, that the novel embodiments can be practiced without these specific details. In other instances, well known structures and devices are shown in block diagram form in order to facilitate a description thereof. The intention is to cover all modification, equivalents, and alternatives within the scope of the claims.

FIG. 1 illustrates a pixel-based display 102. The display 102 can be an OLED display. The display 102 can display an image 104 using a group of pixels. The display 102 can implement a first conventional pixel shifting scheme. This conventional pixel shifting scheme can move the display position of the image 104 along an orbit 106. The orbit 106 can be intended to shift the pixels used to the display the image 104 in all directions. By moving the display position of the image 104, the pixel shifting scheme aims to distribute pixel usage to an extended area outside of the original display area. Further, this first conventional pixel shifting scheme can be considered to be a universal pixel shifting scheme as it can be applied to all areas of the display screen, implying that each pixel has equal chance of coverage as a result of the shift.

Figure 2:
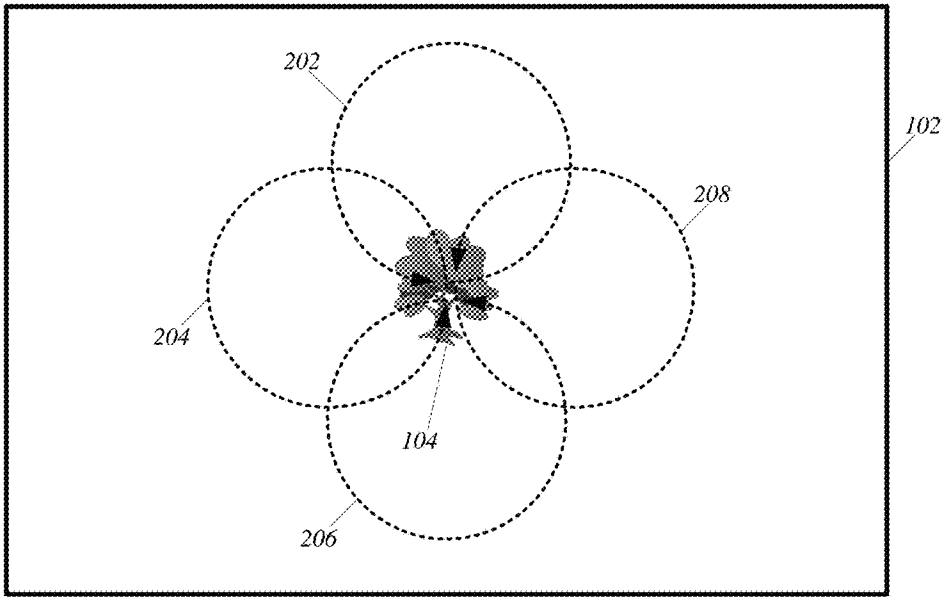
FIG. 2 illustrates a second pixel shifting scheme.

FIG. 2 illustrates implementation of a second conventional pixel shifting scheme by the display 102. Pixels used to display the image 104 are shifted along four orbits 202, 204, 206, and 208. This second conventional pixel shifting scheme can be an improved pixel shifting scheme in comparison to the pixel shifting scheme illustrated in FIG. 1 in that the movements of the image 104 are more difficult to be visually recognized by an observer.

The pixel shifting schemes illustrated in FIGS. 1 and 2 are limited in their effectiveness since they are universal, static, and independent of existing damage. Specifically, the pixel shifting schemes illustrated in FIGS. 1 and 2 are limited since the same pixel shifting scheme is applied to the whole area of the display screen (i.e., universal), the pixel shifting scheme remains the same over time (i.e., static), and the pre-determined shifting pattern is always used regardless of existing pixel usage history (i.e., independent of damage). Because these conventional pixel shifting schemes are implemented without being based on actual pixel usage patterns, each scheme can potentially increase the rate of damage to the display 102 in some portions as opposed to minimizing it.

In various embodiments described herein, historical data for content that has been displayed on an OLED screen or display is maintained or tracked. As an example, historical data for content that has been displayed by the OLEDs can be maintained in a device driver of a graphics processing unit (GPU) (e.g., in a notebook computer) and/or in a memory. In various other embodiments, this pixel usage history could be maintained directly by an Operating System (OS), or through extension middleware or applications provided by independent software vendors.

In various embodiments described herein, the historical data for content that has been displayed by the OLEDs can be exploited or used by a pixel history generation (PHG) algorithm. The PHG algorithm can analyze the tracked historical data to generate or update a damage signature (DS) that is representative of the damage that has be incurred by the OLED display. The PHG can make this damage signature available to the entity (e.g., notebook computer or handheld computer) implementing the history-aware pixel shifting (HAPS) algorithm.

In various embodiments, the damage signature can include a set of priority levels assigned to regions of an OLED display screen. The priority levels can be based on damage that has occurred to the regions. As an example, heavily aged pixels and/or regions can be assigned low priority levels to reduce future usage while less used pixels and/or regions can be assigned high priority levels to ensure increased future usage.

As an example, the historical pixel usage data can provide an indication as to which regions and/or pixels of an OLED display have been used more heavily and/or which regions and/or pixels have a longer age or period of use. The pixel usage data can further provide an indication of which pixels and/or regions are closer to reaching an age or use level that could result in burn-in or some other undesirable display effect. This age or use level can be used to set a usage threshold for a pixel and/or region that the pixel shifting techniques described herein can attempt to avoid. That is, techniques described herein provide for the selection and generation of pixel shifting schemes that can be based on historical usage data and current image data to minimize further damage to a display and/or minimize the likelihood of further aging certain regions and/or pixels of a display that may be close (e.g., in terms of age and/or usage time) to reaching a threshold usage level that corresponds to burn-in or some other undesirable display effect.

FIG. 3 illustrates a portion of an exemplary pixel shifting pattern 300. The pixel shifting pattern 300 can consist of multiple steps 302. Column 304 can represent the position of a center pixel of an image to be displayed in a first direction (e.g., an x direction). Column 306 can represent the position of the center pixel of the image in a second direction (e.g., a y direction). Each step 302 can thereby specify the next center position of the image using the center point specification in the x direction 304 and the y direction 306. Accordingly, a center point position of "(0,0)" as represented by 304 and 306 can represent the starting location of the center pixel of the image (as shown by step #0). Subsequent steps 302 can therefore represent the center coordinate of where the image is being shifted to in both the x and y directions (based on center x and y data 304 and 306). As shown in FIG. 3, an image can be shifted one pixel step at a time.

Further, the pattern 300 can specify the amount of time the image stays at each step/pixel position. As an example, the amount of time can be represented as a fraction of a frame rate of the display providing the image. As shown in FIG. 3, the pattern 300 specifies that the image stays at each step 302 for an amount of time approximately equal to the inverse of the frame rate but is not so limited. In general, any amount of time and any change in pixel position between steps can be specified. Further, a different sequence of steps can lead to a modified version of the pattern 300.

In various embodiments, pixel shifting patterns can be provided that incorporate two additional parameters: applicability and dynamism. Applicability, for example, can be regional or universal. Dynamism, for example, can be with respect to time or space. Based on the introduction of these two additional parameters to a pixel shifting scheme, four different pixel shifting scheme combinations can be provided: (1) universal, time dynamism in pixel shifting patterns; (2) universal, space dynamism in pixel shifting patterns; (3) per-region, time dynamism in pixel shifting patterns; and (4) per-region, space dynamism in pixel shifting patterns. Each of these schemes are described in further detail herein.

In various embodiments, universal time dynamism can be provided in a HAPS algorithm. As an example, such a scheme can include a time-weighted factor. The time-weighted factor can specify the amount of time an image will stay at each step during a pixel shifting process window. Universal, time dynamism in pixel shifting patterns can therefore involve dynamic time weighted factors for each steps.

FIG. 4 illustrates a portion of an exemplary pixel shifting pattern 400. The pixel shifting pattern 400 includes a dynamic time weighted factor 402 for each step 302 (shown as time weighted factors "a0", "a1", "a2", etc.). The dynamic time weighted factors 402 can determine how often or how long the coordinate positions 304 and 306 of each step 302 is used or covered.

In various embodiments, the time weighted factors 402 are not constant or fixed. Instead, the time weighted factors 402 can be varied based on the characteristics of the image to be shown and the pixel usage history. Over time, the statistical effect of the pixel shifting scheme specified by the pattern 400 can result in preferred coverage of certain spaces or location of a display, as well as over preferred portions of time. Accordingly, the pattern 400 can be adjusted so as to enable a way to influence future coverage in areas of the screen that are at a higher risk of burn-in.

As an example, for a relatively new display, minimum burn-in impact can be provided by adjusting the pixel shifting pattern 400 to ensure that the pixels used for shifting are spread over as wide an area of the display as possible. Accordingly, the value of time weighted factors 402 can be based on the image to be shown.

As another example, the pixel shifting algorithm that generates the pattern 400 can begin with time-weighted factor values 402 having the same value of "1" in each step 302. Over time, the time weighted factors 402 can be increased for steps 302 corresponding to the destination pixels with lower brightness values as less bright pixels have less burn-in risk.

As another example, the pixel shifting algorithm that generates the pattern 400 can begin with time-weighted factor values 402 having the same relatively high values (e.g., >"1") in each step 302. Over time, the time weighted factors 402 can be decreased steps 302 corresponding to the destination pixels with higher brightness values as brighter pixels have higher risk of burn-in. Overall, the introduction of the time-weighted factors 402 can adjust the future usage of certain pixels which can be based on pixel usage data. Further, FIG. 4 can represent the specification of a HAPS algorithm that includes universal, time dynamism according to techniques disclosed herein.

Figure 5A:
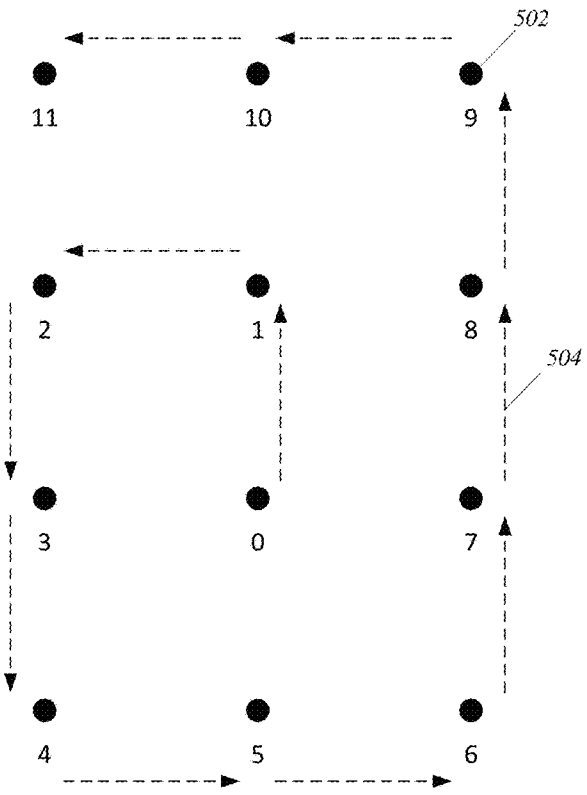
FIG. 5A illustrates a first exemplary pixel shifting sequence.
Figure 5B:
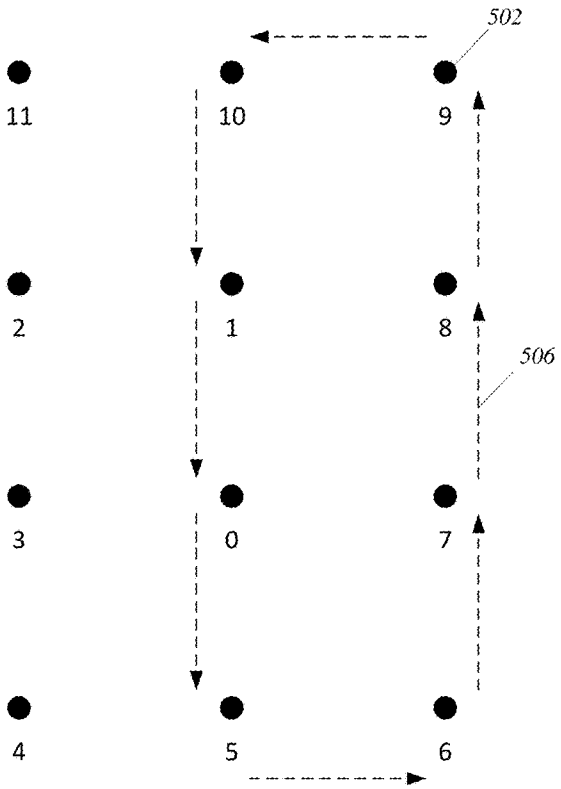
FIG. 5B illustrates a second exemplary pixel shifting sequence.
Figure 5C:
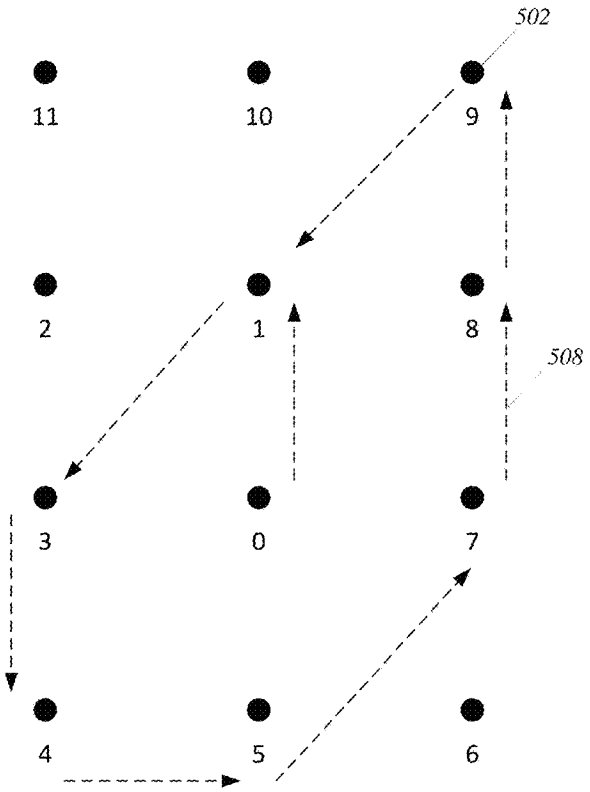
FIG. 5C illustrates a third exemplary pixel shifting sequence.

FIGS. 5A-5C illustrate pixel shifting patterns that include universal, space dynamism. In various embodiments, HAPS algorithms described herein can generate pixel shifting patterns that include time weighted factors that have values of zero such that certain steps can be skipped or jumped over. By skipping or jumping over certain steps of the pixel shifting pattern, regions with can be avoided or sought based on historical data and/or a derived damage signature. This can provide a manner of introducing space dynamism into a pixel shifting scheme according to the techniques described herein.

As shown in FIG. 5A, multiple pixel positions 502 are shown (e.g., having positions values 0 through 11) representing a portion of an OLED display. A pixel shifting sequence 504 is shown with steps forming a pattern around a center of an image. The pixel shifting sequence 504 does not skip any steps such that each pixel position 502 is used.

In contrast, FIG. 5B illustrates a pixel shifting sequence 506 that favors a right side of the display in comparison to a left side of the display. Specifically, the pixel shifting sequence 506 steps through pixel position 502 values 0, 5, 6, 7, 8, 9, 10, and 1. The other remaining pixel positions 502 can be skipped. The pixel shifting sequence 506 can be specified by setting the weights for the following pixel position transitions to zero (such that the transitions are skipped): 0–>1, 1–>2, 2–>3, 3–>4, 4–>5, and 10–>11. The weighting of certain transitions can be set to zero based on historical data and/or the damage signature for a display so as to favor shifting in certain portions of a display in comparison to other portions of the display.

FIG. 5C illustrates a pixel shifting sequence 508 that also includes certain pixel position transitions that are set to zero weights. In particular, the pixel shifting sequence 508 can set the pixel transitions from 1–>2 and from 2–>3 to have zero weights to enable a jump directly from pixel positions 1 to 3. Further, transitions from 5–>6 and 6–>7 can be set to zero weights to enable a jump from 5 to 7, thereby enabling the pixel shifting sequence 508 to trace a diagonal pattern.

Overall, FIGS. 5A-5C illustrate the implementation of a HAPS algorithm that includes universal, space dynamism according to techniques disclosed herein. In various embodiments, pixel shifting sequences that incorporate both time and space dynamism can be formed in accordance with techniques described herein.

Further, in various embodiments, a device OS and/or a display application can determine when to implement time and/or space dynamism in conjunction with a HAPS algorithm. Determining when to use time and/or space dynamism in conjunction with a HAPS algorithm can be based on heuristics resulting from analysis of a current image to be displayed. The heuristics can identify scenarios where some jerkiness in movement (e.g., caused by pixel shifting of an image) is acceptable, or where use of a HAPs algorithm may not compromise the goal of prioritized damage avoidance.

Figure 6A:
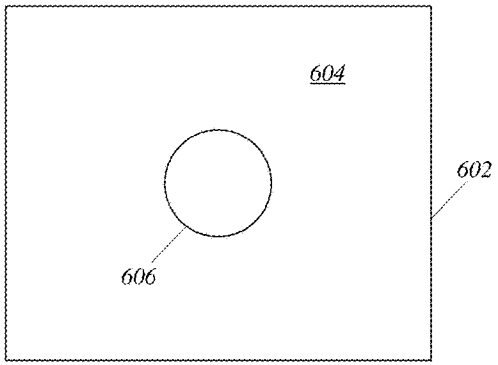
FIG. 6A illustrates a first exemplary static image.
Figure 6B:
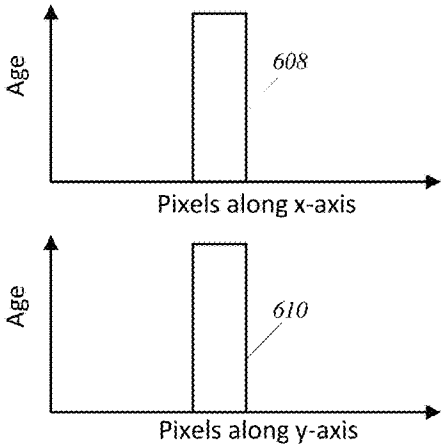
FIG. 6B illustrates an expected age distribution of a portion of the pixels for displaying the image of FIG. 6A when pixel shifting is not used.

FIGS. 6A-6D illustrate an example image and different pixel usage patterns expected with different exemplary shifting schemes. Specifically, FIG. 6A illustrates an exemplary static image 602. The static image 602 can include a solid background 604 of a first color (e.g., black) and a solid foreground image 606 of a second color (e.g., blue). FIG. 6B illustrates the expected typical age distribution of the blue component of all pixels of the image 602 shown in FIG. 6A when pixel shifting is not used. Specifically, distribution 608 shows the expected typical age distribution for the blue component of all the pixels for the image 602 along the x-axis and distribution 610 shows the expected typical age distribution for the blue component of all the pixels for the image 602 along the y-axis when no pixel shifting scheme is implemented. FIG. 6A can represent an example of an image 602 where universal HAPS may still be used if higher damage is along the edges of the screen.

Figure 6C:
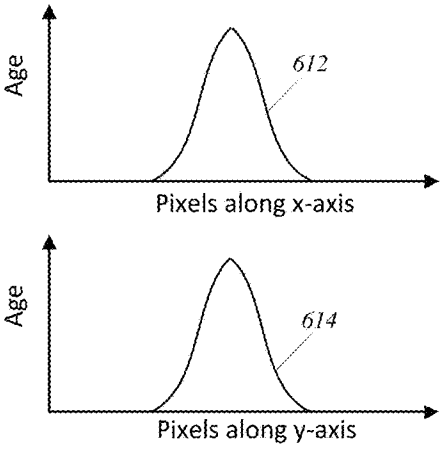
FIG. 6C illustrates an expected age distribution of a portion of the pixels for displaying the image of FIG. 6A when a first pixel shifting scheme is used.

FIG. 6C illustrates the expected age distribution of the image 602 when a first pixel shifting method is used. Specifically, distribution 612 shows the expected age distribution for the blue component of all the pixels for the image 602 along the x-axis and distribution 614 shows the expected age distribution for the blue component of all the pixels for the image 602 along the y-axis when the first pixel shifting scheme is implemented. The first pixel shifting scheme can be a scheme that does not include any time weighting.

Figure 6D:
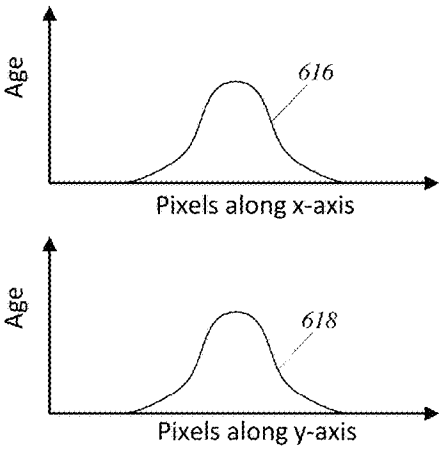
FIG. 6D illustrates an expected age distribution of a portion of the pixels for displaying the image of FIG. 6A when a second pixel shifting scheme is used.

FIG. 6D illustrates the expected age distribution of the image 602 when a second pixel shifting method is used. The second pixel shifting method can be used in conjunction with or can include a time weighted factor. Distribution 616 shows the expected age distribution for the blue component of all the pixels for the image 602 along the x-axis and distribution 618 shows the expected age distribution for the blue component of all the pixels for the image 602 along the y-axis when the second pixel shifting scheme is implemented. As can be seen, the distributions of FIG. 6D (e.g., distributions 616 and 618) are spread out over a wider portion of the x and y axes than the distributions of FIG. 6C (e.g., distributions 612 and 614).

The use of time weighted factors for all steps of a pixel shifting pattern can determine the future usage of the pixels. As such, the time weighted factors can determine the usage pattern of the pixels. With a pixel shifting pattern that does not use time weighting factors, all steps of the pixel shifting pattern can be driven with the pixel value for an equal amount of time. As a result of this type of pixel shifting, the expected pixel usage pattern can resemble the distributions shown in FIG. 6C (e.g., distributions 612 and 614). As shown in FIG. 6C, pixel usage is spread over a wider area than the area when no pixel shifting is applied as shown in FIG. 6B (e.g., compare the widths of the distributions 608 and 610 to distributions 612 and 614, respectively). Further, by implementing pixel shifting, center pixel usage can be reduced. However, center pixel usage can still be significantly higher than edge pixel usage.

To avoid further coverage on the center pixels that have high brightness values and to achieve a future usage pattern that will resemble the distributions 616 and 618 shown in FIG. 6D, universal time-space dynamism can be used to manipulate the time weighted factors of a pixel shifting pattern. Using universal time-space dynamism to manipulate the time weighted factors can ensure that the center pixels get less coverage during the pixel shifting process. As a result, over time this will result in a future usage that is spread into an extended area with usage on center pixels being smoothed. This is evident by comparing the distributions 616 and 618 to the distributions 612 and 614, respectively—the heights of the distributions 616 and 618 are lower than the heights of the distributions 612 and 614, respectively, and the widths of the distributions 616 and 618 are wider than the widths of the distributions 612 and 614, respectively.

Overall, by introducing the use of time weighted factors with a pixel shifting scheme, peak usage of certain pixels can be reduced. As a result of reducing peak usage, the time when peak usage reaches a burn-in threshold can be delayed.

FIGS. 7A-B illustrates a portion of an exemplary pixel shifting pattern 700. The pixel shifting pattern 700 can generate the usage pattern and distributions shown in FIG. 6D. The pixel shifting pattern 700 can include four orbits 702, 704, 706, and 708.

Each of the orbits 702-708 can include multiple steps 710. For each step value 710 provided, a corresponding position of a center pixel of an image in a first direction (e.g., an x direction) 712 can be provided along with a corresponding position of a center pixel of an image in a second direction (e.g., a y direction) 714. The center pixel positions 712 and 714 can specify a pixel shift—that is, the next center position of the image using the center point specification in the x direction 712 and the y direction 714.

Further, the pattern 700 can specify the amount of time 716 the image stays at each step/pixel position. As an example, the amount of time 716 can be represented as a fraction of a frame rate of the display providing the image. As shown in FIGS. 7A-7B, the pattern 700 specifies that the image is to stay at each step 710 for an amount of time 716 that is approximately equal to the inverse of the frame rate but is not so limited. The pixel shifting pattern 700 can further include time weighted factors 718. The time weighted factors 718 can increase or decrease the amount of time a pixel shift stays at a particular step 710. Specifically, higher time weighted factors 718 can ensure a shift position is maintained for a longer period of time in comparison to a lower time weighted factor 718 corresponding to a shorter period of time.

In various embodiments, for steps 710 of orbits 702-708 that are directed to pixel positions that are further away from a center of the display, relatively higher valued time weighted factors 718 can be used. Further, for steps 710 of orbits 702-708 that are directed to pixel positions that are closer to the center, relatively lower valued time weighted factors 718 can be used. Accordingly, for pixel positions near the center, the time weighted factors can be equal to or close to "1". As the distances in the x and y directions from center increase (e.g., as Δx and Δy relative to a center position increase), the time weighted factors 718 can increase and reach a maximum. By using the time weighted factors 718 in this manner, a usage distribution pattern of the pixels can become smoothed out like the distributions 616 and 618 shown in FIG. 6D. Further, the use of the time weighted factors 718 can provide a preferred pixel usage pattern by biasing the time weighted factors 718 of all shifting steps 710.

Figure 8A:
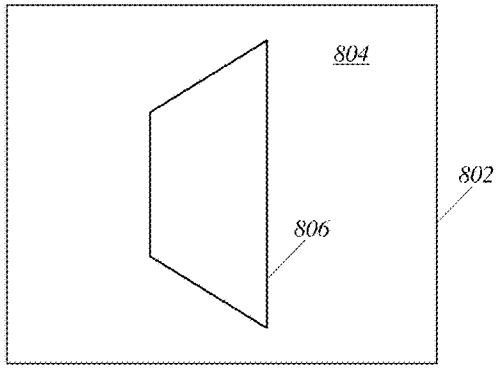
FIG. 8A illustrates a second exemplary static image.

FIGS. 8A-8D illustrate an example image and different pixel usage patterns expected with different exemplary shifting schemes. Specifically, FIG. 8A illustrates an exemplary static image 802. The static image 802 can include a solid background 804 of a first color (e.g., black) and a solid foreground image 806 of a second color (e.g., blue). The image 806 can be a non-symmetric image such that a pixel usage pattern to display the image 806 can be non-symmetric.

Figure 8B:
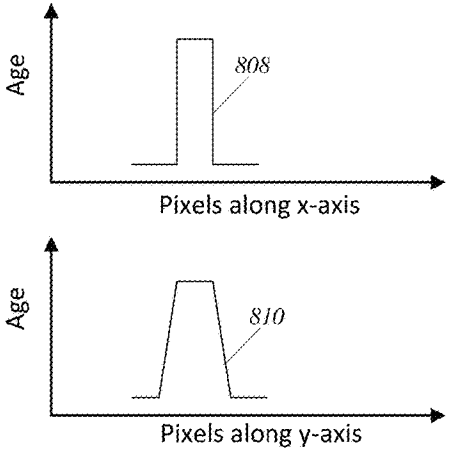
FIG. 8B illustrates an expected age distribution of a portion of the pixels for displaying the image of FIG. 8A when pixel shifting is not used.
Figure 8C:
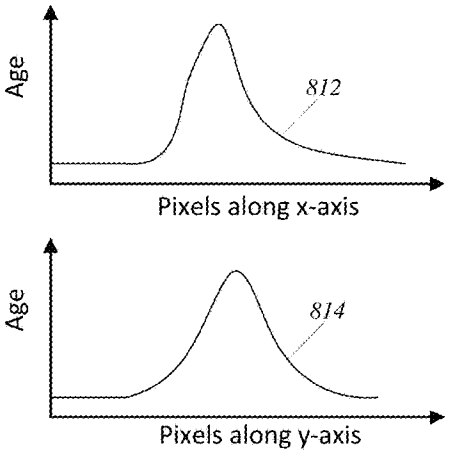
FIG. 8C illustrates an expected age distribution of a portion of the pixels for displaying the image of FIG. 8A when a first pixel shifting scheme is used.
Figure 8D:
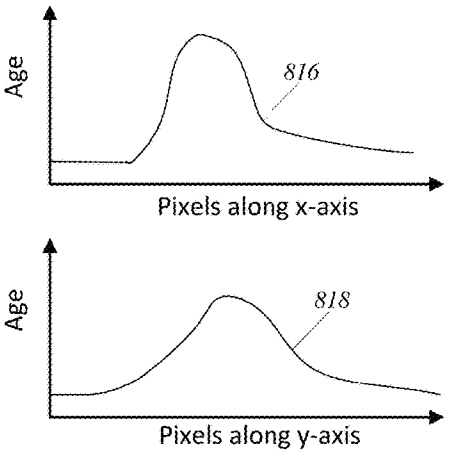
FIG. 8D illustrates an expected age distribution of a portion of the pixels for displaying the image of FIG. 8A when a second pixel shifting scheme is used.

FIG. 8B illustrates pixel age distributions 808 and 810 along x and y axes, respectively, when no pixel shifting scheme is used. FIG. 8C illustrates pixel age distributions 812 and 814 along x and y axes, respectively, when a pixel shifting scheme is used but does not include time weighted factors. FIG. 8D illustrates pixel age distributions 816 and 818 along x and y axes, respectively, when a pixel shifting scheme is used that does include time weighted factors.

FIG. 8C shows that a pixel shifting scheme that does not use time weighted factors can result in a non-symmetric usage distribution along the x direction (e.g., distribution 812). While the distributions of FIG. 8C provide an improvement over the distributions 808 and 810 where no pixel shifting applied, the distributions 812 and 814 of FIG. 8C can still exhibit a biased and/or non-symmetric usage pattern. Although the distributions 812 and 814 are wider than the distributions 808 and 810, the pixels on the left side along the x-axis can be used significantly more than the pixels on the right side along the x-axis for the resulting usage distribution 812.

The distributions 816 and 818 shown further improvement over the distributions 812 and 814 by biasing the time weighted factors appropriately. Specifically, the distributions 816 and 818 can be biased such that pixel shifting steps that involve the left side of the display where usage is relatively high can get less coverage and pixel shifting steps that involve the right side of the display where usage is relatively low can get increased coverage. In doing so, the non-symmetric usage distribution along the x-direction can be further improved or even cancelled out (compare distribution 812 to distribution 816). FIG. 8D can represent the resulting pixel usage patterns or distributions 816 and 818 based on this addition of time weighted pixel shifting.

The pixel shifting examples illustrated in FIGS. 6A-6D and FIGS. 8A-8D show how time weighted factors can be applied to pixel shifting schemes to provide more evenly distributed pixel usage and/or pixel usage distributed over preferred areas or regions based on a damage signature or age profile of a display. In turn, lower pixel usage and aging can be provided when no burn-in conditions exists.

As an OLED screen or display continues to be used, uneven usage of the pixels can develop. The techniques described herein can respond by combining a pixel shifting scheme with time weighted factors to provide flexibility in the pixel shifting scheme to avoid potential burn-in damage by using the knowledge of existing accumulated pixel usage data/history. Adjustments to the time weighted factors can be accomplished by relying on the damage signature. As mentioned above, the damage signature for a display can specify priority levels for certain pixels and/or areas of the display. Time weighted factors can then be selected and modified over time based on updates to these priority levels while also being adjusted based on the current image to be shown.

Overall, the techniques described herein can be used to generate a pixel shifting scheme that accounts for accumulated usage data/history of the pixels formed by the OLED display and the characteristics of the image to be displayed (e.g., symmetric or non-symmetric) to reduce usage of areas at higher risk of burn-in and increase usage of areas with lower risk of burn-in, thereby delaying the onset of burn-in for the OLED display.

Figure 9:
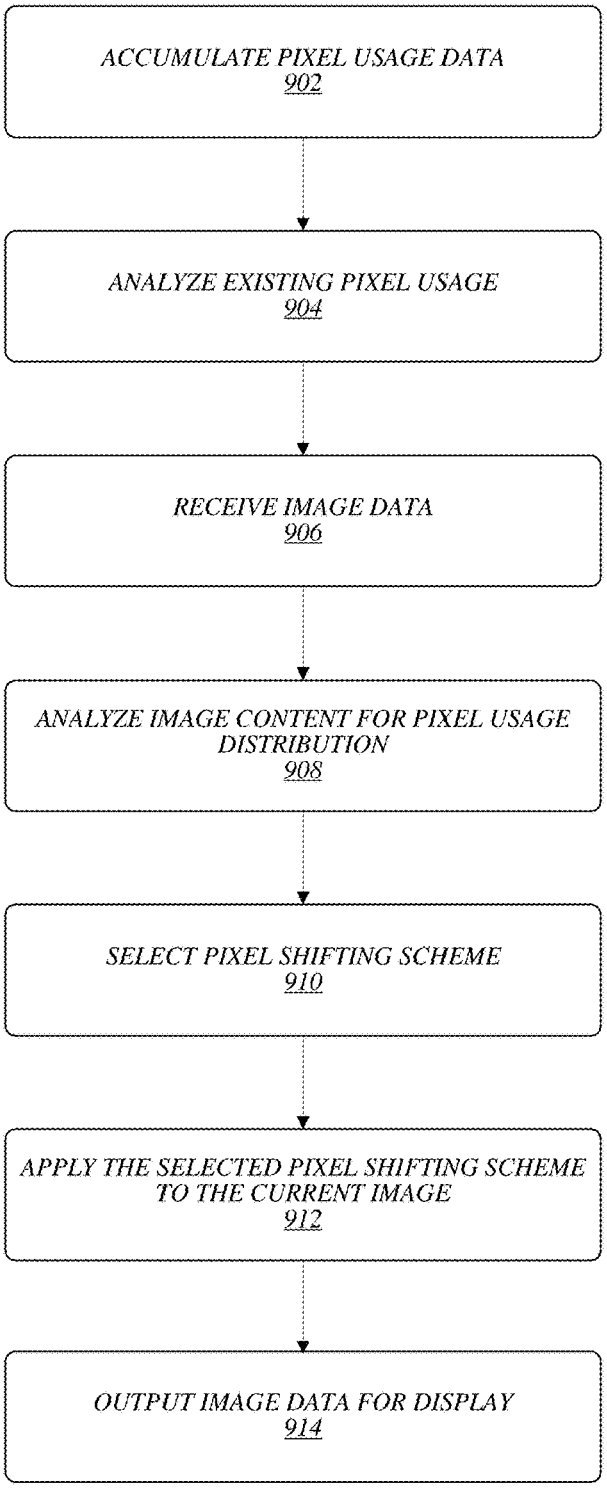
FIG. 9 illustrates an embodiment of a first logic flow.

FIG. 9 illustrates an example of a logic flow 900 that may represent generation of a history-aware pixel shifting scheme to be applied to an OLED display based on the techniques described herein. As examples, the logic flow 900 can be used to generate the pixel shifting pattern 300 of FIG. 3, the pixel shifting pattern 400 of FIG. 4, the pixel shifting patterns illustrated in FIGS. 5A-5C, the pixel shifting pattern 700 of FIGS. 7A-7B, and any of the the pixel usage distributions depicted in FIGS. 6B-6D and FIGS. 8B-8D.

At 902, pixel usage data is accumulated. The pixel usage data can be usage data for pixels of an OLED display. The pixel usage data can include a history of the usage of each pixel of the OLED display over time based on the images displayed by the OLED display. The accumulated pixel usage data can be stored in a memory. The accumulated pixel usage data can be maintained by an OS, an application, or a dedicated display driver or software system. The accumulated pixel usage data can include an amount of time each pixel has been used and/or can include an age profile for each pixel.

In various embodiments the accumulated pixel usage data can be based on prior displayed images or content, can indicate an age of each pixel or region of the OLED display, can indicate a total amount of use of each pixel of the OLED display, can indicate a luminance level of each pixel of the OLED display, and/or can indicate a brightness level of each pixel of the OLED display.

At 904, the existing accumulated pixel usage data from step 902 can be analyzed. The analysis can determine which pixels and/or portions of the OLED display have been used heavily and which pixels and/or portions of the OLED display have been used less heavily. Further, the analysis can provide an indication as to which pixels and/or regions of the OLED display are close to experiencing burn-in, have a high risk of experiencing burn-in, and/or currently experience burn-in. The analysis can provide a damage signature for the OLED display. As an example, the analysis can generate a damage signature that can comprise a set of priority levels assigned to regions or pixels of the OLED display with heavily aged pixels/regions being assigned low priority (for low future usage) and less used pixels/regions being assigned high priority (for increased usage). Overall, the analysis at 904 can provide an assessment of which pixels/regions of an OLED display should be attempted to be used more and which pixels/regions should be attempted to be used less in order to delay the onset of burn-in or other damage to the OLED display. A usage profile for each pixel or region of the OLED display can be generated based on the accumulated pixel usage data. The usage profile can include any of the information described herein including a damage profile and/or any information indicating an age, brightness level, luminance level, or proximity in terms of use or age to a burn-in threshold for any pixel or region of the OLED display.

At 906, image data can be received. The image data can represent information for displaying a current image on the OLED display. The image to be displayed can be a symmetric or non-symmetric or asymmetric image. The image data can be for any image to be displayed.

At 908, the image data can be analyzed. The image data can be analyzed to determine how pixels are to be used to display the image. In various embodiments, the analysis can determine a pixel usage distribution for the image data by assuming no pixel shifting is to be used in displaying the image. By doing so, the analysis at 908 can provide an indication as to what pixels and/or regions of the OLED display will be impacted by displaying the image data.

At 910, a pixel shifting scheme can be selected and/or generated. The pixel shifting scheme can be selected and/or generated based on the accumulated pixel usage data and the analysis thereof along with the image data and the analysis thereof. In various embodiments, the pixel shifting scheme can be selected based on the damage signature of the OLED display, the historical pixel usage of the OLED display (e.g., the age profile of the pixels), and/or the content of the image to be displayed. The pixel shifting scheme can include a sequence of steps forming one or more image shifting orbits. The sequence of steps can specify shifts of the image relative to a center of the image. That is, each step can specify a location to display the image on the OLED display relative to a center of the image. The specified locations can be pixel positions of the OLED display. These specified locations can include a horizontal (or x-axis) positional indicator and a vertical (or y-axis) positional indicator.

The pixel shifting scheme can specify an amount of time corresponding to each positional shift of the image. Further, the pixel shifting scheme can include time and/or space dynamism. In various embodiments, the pixel shifting scheme can provide time and/or space weighted factors such that certain positional shifts are used or skipped and amounts of time at certain positions are longer than amounts of time at certain other positions. The pixel shifting scheme can be optimized based on the accumulated usage data and current image data to delay the onset of burn-in by, for example, favoring less used pixels/regions in comparison to more heavily used pixels/regions.

At 912 the selected pixel shifting scheme can be applied to the current image. The pixel shifting scheme can be used to adjust the pixel usage for displaying the image. As an example, the pixel shifting scheme can ensure the image is displayed with high quality while minimizing the risk of burn in by using more pixel/regions having less usage over time and using fewer pixel/regions having more usage over time. Applying the generated pixel shifting pattern to the image data of the image can generate modified image data. The modified image data can represent data for displaying the image according to the pixel shifting pattern.

At 914, the modified image data can be provided for display. The modified image data after undergoing pixel shifting can be provided to an OLED display for rendering the image. That is, the modified image data can be outputted for display on an OLED display such that the image is displayed according to the pixel shifting pattern applied.

The logic flow 900 can be implemented by any of the devices described herein and can be implanted in hardware, software, or any combination thereof.

Various embodiments and techniques are described herein in relation to OLED displays but are not so limited. The embodiments and techniques described herein can be applied to any self-emissive and/or pixel-based displays including, for example, plasma displays, micro LED displays, and quantum dot LED (QLED) displays as well as liquid crystal displays (LCDs).

Figure 10:
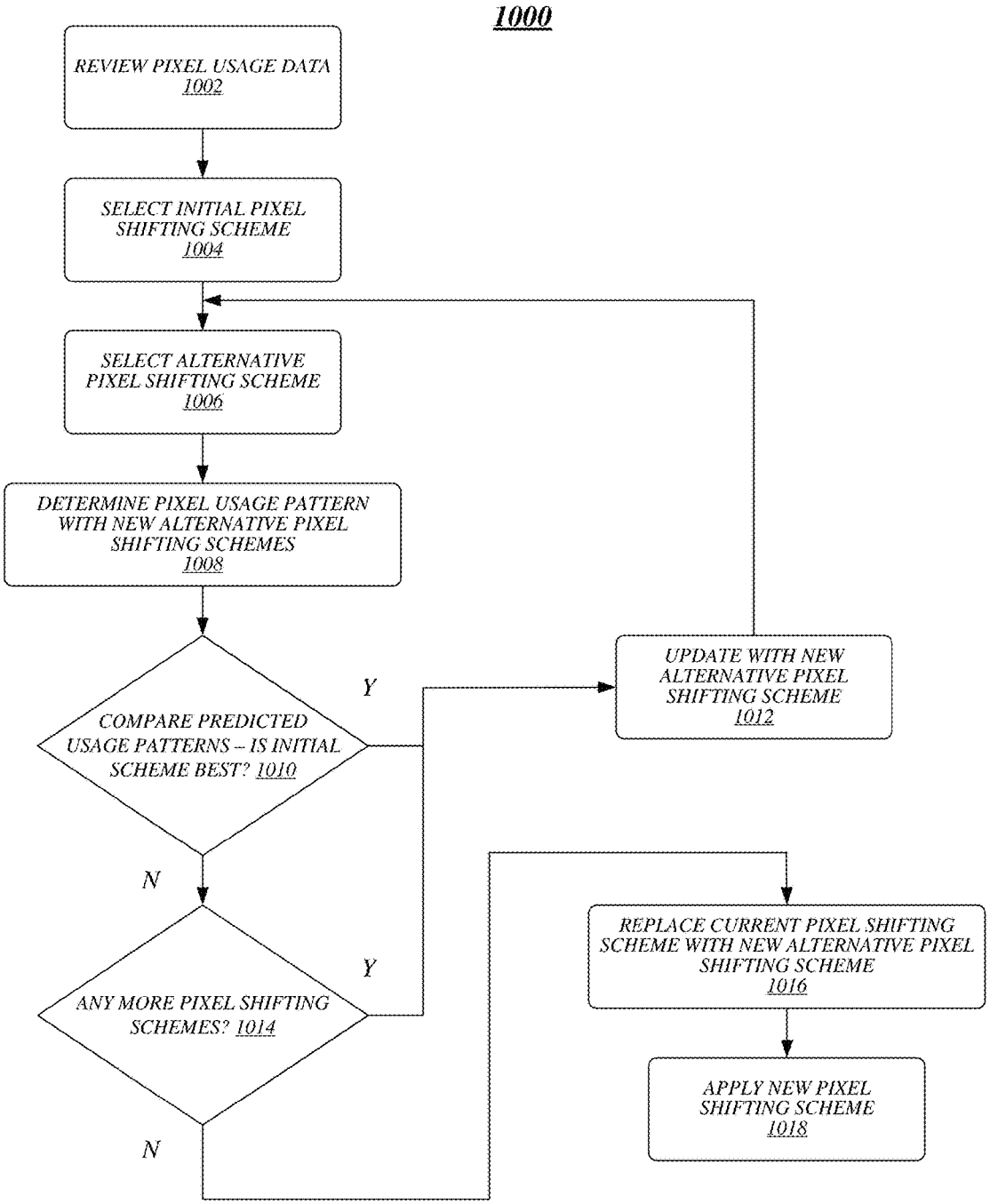
FIG. 10 illustrates an embodiment of a second logic flow.

FIG. 10 illustrates an example of a logic flow 1000 that may represent selection of a history-aware pixel shifting scheme to be applied to an OLED display based on the techniques described herein. The logic flow 1000 as well as other techniques described herein enable a pixel shifting pattern to be updated periodically based on usage data and current image data.

At 1002, pixel usage data can be reviewed. As example, the pixel usage data can be read from a memory.

At 1004, an initial pixel shifting scheme can be selected. As an example, the initial pixel shifting scheme can be a pixel shifting scheme that does not include any space or time dynamism. That is, the initial pixel shifting scheme can specify positional steps and times having all equal weights. This initial pixel shifting scheme can be a baseline pixel shifting scheme and can be considered to be an initial preferred pixel shifting scheme.

At 1006, an alternative pixel shifting scheme can be selected. The alternative pixel shifting scheme can be include space and/or time dynamism. As an example, the alternative pixel shifting scheme can include time weighted factors and/or positional weighted factors. The alternative pixel shifting scheme can be selected from a group of alternative pixel shifting schemes.

At 1008, a pixel usage pattern based on the alternative pixel shifting scheme can be calculated.

At 1010, a comparison of the pixel usage pattern derived in 1008 can be compared to the expected pixel usage pattern for the initial or baseline pixel usage pattern from 1004. As an example, the resulting pixel usage patterns for a given image can be determined based on the initial and alternative pixel shifting schemes. A determination can then be made from the predicted patterns which pixel shifting scheme will likely result in best delaying the onset of burn-in, prevent further damage to an OLED display, and/or best distribute usage of pixels while maintaining a desired image display quality. Other metrics can be used for comparing the predicted usage patterns to determine which usage pattern is preferred. As an example, a pixel shifting pattern can be chosen base don its ability to introduce the less additional damage to a display or to age certain pixels and/or regions of the display the least amount.

If the initial pixel shifting scheme is determined to be preferred over the alternative pixel shifting scheme, then the logic flow can progress to 1012. At 1012, a process for selecting a next alternative pixel shifting scheme can be implemented. After 1012, operations shown in 1006, 1008, and 1010 can be repeated to compare a next pixel shifting scheme to the initially selected baseline pixel shifting scheme.

If the initial pixel shifting scheme is determined not to be preferred (e.g., the alternative pixel shifting scheme is determined to be preferred), then the logic flow can progress to 1014. At 1014, it can be determined if any additional alternative pixel shifting schemes are available for evaluation. If additional pixel shifting schemes are available, the logic flow can progress to 1012. If no additional pixel shifting schemes are available, the logic flow can progress to 1016. Operations 1014 and 1012 can ensure that all schemes are evaluated and compared to a current preferred scheme before making a final decisions as to what pixel shifting scheme to use. In this way, an optimal pixel shifting scheme can be selected.

At 1016, the current pixel shifting scheme determined to be preferred in 1010 can be replaced and/or updated with the pixel shifting scheme determined to be preferred in 1010.

At 1018, the selected pixel shifting scheme can be applied. The selected pixel shifting scheme can be applied to a current image to be displayed.

Techniques described herein can also provide for a display area of an OLED display to be divided or parsed into multiple segments or partitions. Each segment can have distinct usage characteristics. For example, an OLED display that is used to display an user interface for an OS can have certain segments that are relatively static (e.g., that display the same images repeatedly or constantly) while other segments can vary more frequently (e.g., that consistently display different images). Accumulated historical data of pixel usage can reveal these different multiple usage segments of an OLED display and can be used to determine the differently used segments of an OLED display. Further, techniques described herein can be used to apply different pixel shifting schemes to each separately identified segment.

Figure 11:
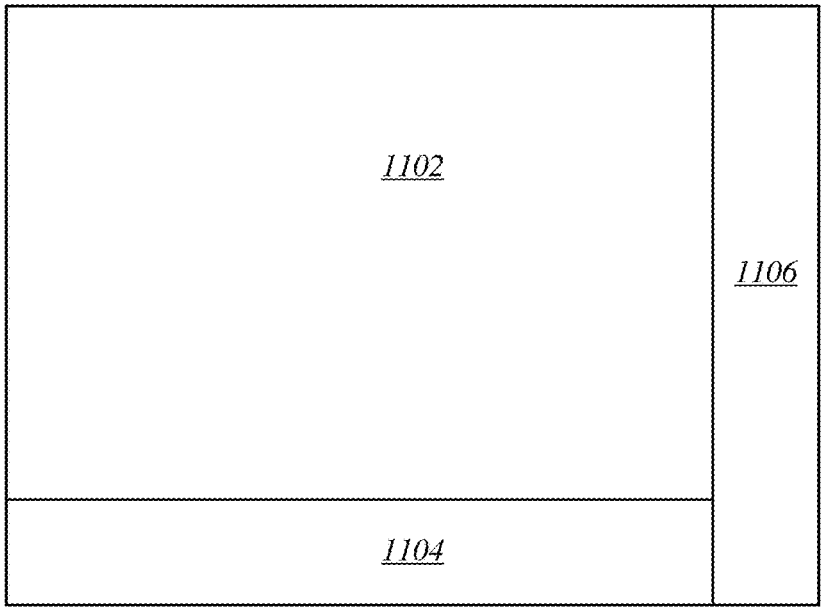
FIG. 11 illustrates an exemplary OLED display divided into multiple different usage segments.

FIG. 11 illustrates an exemplary OLED display 1100 that can be divided (or parsed or partitioned) into multiple different usage segments 1102, 1104, and 1106. The usage segments 1102, 1104, and 1106 can be non-overlapping but are not so limited. As an example, segments 1104 and 1106 can be used to display user interface OS toolbars which are shown on the display almost constantly. Segment 1102 can be a multiple purpose portion of the displayed user interface that frequently changes what is displayed in the segment 1102. Based on the techniques described herein, the number, size, and positions of each of the segments 1102, 1104, and 1106 can be determined based on the historical usage data of the pixels of the OLED display 1100. Further, different pixel shifting schemes can be applied to each of the segments 1102, 1104, and 1106 based on the usage characteristics of each segment. Accordingly, FIG. 11 illustrates an example of a per-region application of HAPS algorithms that can include space and/or time dynamism.

In various embodiments, various HAPS algorithms for pixel shifting can be applied to the segments 1102, 1104, and 1106. As an example, a pixel shifting scheme for segment 1104 can be used that is biased to provide more coverage and use along a horizontal direction. For segment 1106, a pixel shifting scheme can be used that is biased to provide more coverage along a vertical direction. For segment 1102, a pixel shifting scheme can be used that provides for shifts evenly along all directions while avoiding certain areas that are at high risk for burn-in if necessary. Such per-region time/space dynamism HAPS could potentially achieve optimal performance to avoid burn-in.

Figure 12:
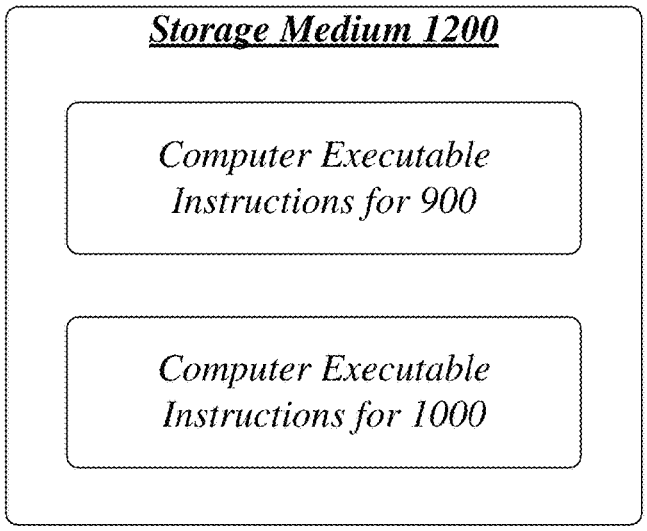
FIG. 12 illustrates an embodiment of a storage medium.

FIG. 12 illustrates an embodiment of a storage medium 1200. Storage medium 1200 may comprise any non-transitory computer-readable storage medium or machine-readable storage medium, such as an optical, magnetic or semiconductor storage medium. In various embodiments, storage medium 1200 may comprise an article of manufacture. In some embodiments, storage medium 1200 may store computer-executable instructions, such as computer-executable instructions to implement one or more of logic flows or operations described herein, logic flow 900 of FIG. 9 and/or logic flow 1000 of FIG. 10. Examples of a computer-readable storage medium or machine-readable storage medium may include any tangible media capable of storing electronic data, including volatile memory or non-volatile memory, removable or non-removable memory, erasable or non-erasable memory, writeable or re-writeable memory, and so forth. Examples of computer-executable instructions may include any suitable type of code, such as source code, compiled code, interpreted code, executable code, static code, dynamic code, object-oriented code, visual code, and the like. The embodiments are not limited in this context.

Figure 13:
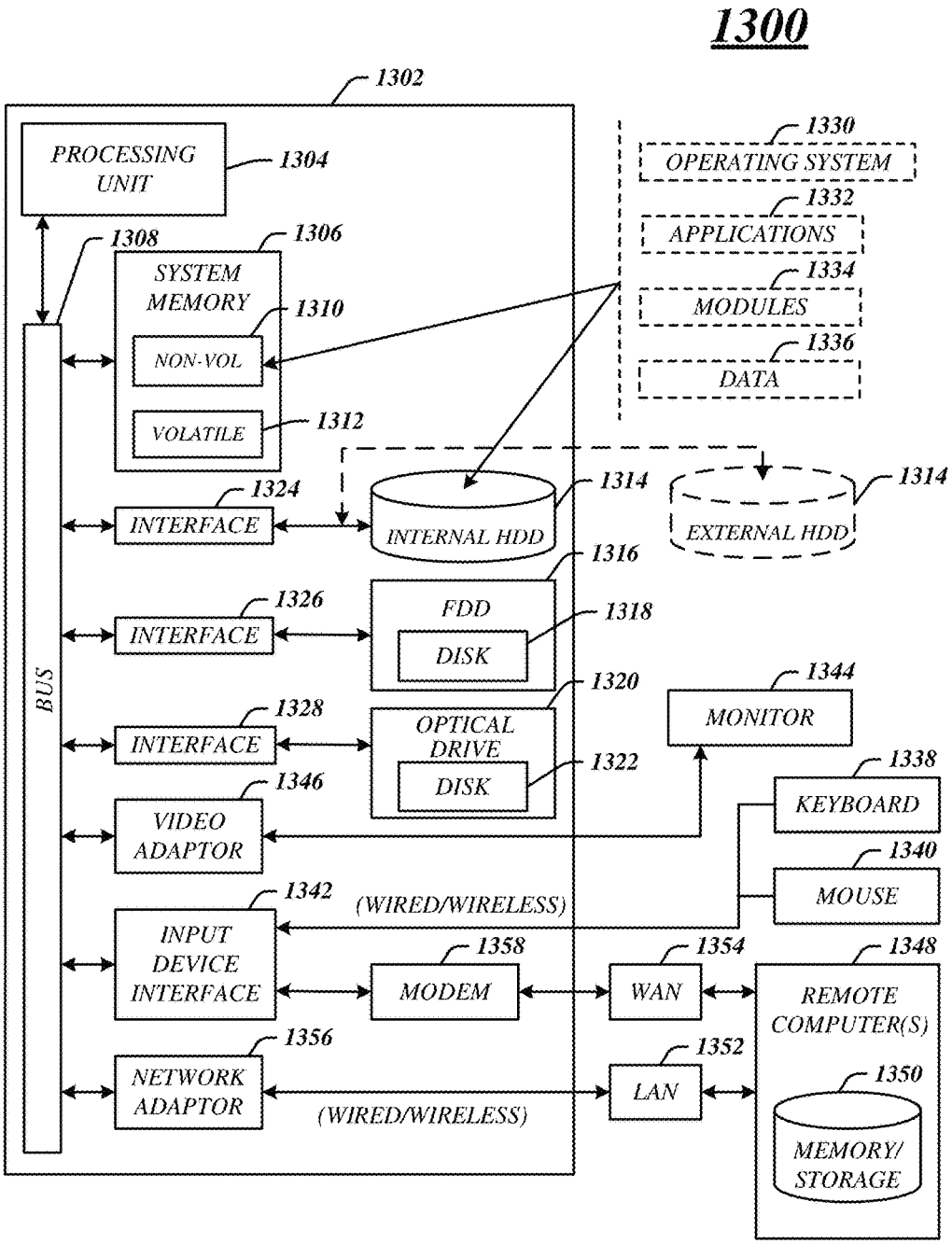
FIG. 13 illustrates an embodiment of a computing architecture.

FIG. 13 illustrates an embodiment of an exemplary computing architecture 1300 that may be suitable for implementing various embodiments described herein. In various embodiments, the computing architecture 1300 may comprise or be implemented as part of an electronic device. In some embodiments, the computing architecture 1300 may be representative, for example, of a processor server that implements one or more techniques for generating or selecting pixel shifting schemes as described herein.

As used in this application, the terms "system" and "component" and "module" are intended to refer to a computer-related entity, either hardware, a combination of hardware and software, software, or software in execution, examples of which are provided by the exemplary computing architecture 1300. For example, a component can be, but is not limited to being, a process running on a processor, a processor, a hard disk drive, multiple storage drives (of optical and/or magnetic storage medium), an object, an executable, a thread of execution, a program, and/or a computer. By way of illustration, both an application running on a server and the server can be a component. One or more components can reside within a process and/or thread of execution, and a component can be localized on one computer and/or distributed between two or more computers. Further, components may be communicatively coupled to each other by various types of communications media to coordinate operations. The coordination may involve the uni-directional or bi-directional exchange of information. For instance, the components may communicate information in the form of signals communicated over the communications media. The information can be implemented as signals allocated to various signal lines. In such allocations, each message is a signal. Further embodiments, however, may alternatively employ data messages. Such data messages may be sent across various connections. Exemplary connections include parallel interfaces, serial interfaces, and bus interfaces.

The computing architecture 1300 includes various common computing elements, such as one or more processors, multi-core processors, co-processors, memory units, chipsets, controllers, peripherals, interfaces, oscillators, timing devices, video cards, audio cards, multimedia input/output (I/O) components, power supplies, and so forth. The embodiments, however, are not limited to implementation by the computing architecture 1300.

As shown in FIG. 13, the computing architecture 1300 comprises a processing unit 1304, a system memory 1306 and a system bus 1308. The processing unit 1304 can be any of various commercially available processors, including without limitation an AMD® Athlon®, Duron® and Opteron® processors; ARM® application, embedded and secure processors; IBM® and Motorola® DragonBall® and PowerPC® processors; IBM and Sony® Cell processors; Intel® Celeron®, Core (2) Duo®, Itanium®, Pentium®, Xeon®, and XScale® processors; and similar processors. Dual microprocessors, multi-core processors, and other multi-processor architectures may also be employed as the processing unit 1304.

The system bus 1308 provides an interface for system components including, but not limited to, the system memory 1306 to the processing unit 1304. The system bus 1308 can be any of several types of bus structure that may further interconnect to a memory bus (with or without a memory controller), a peripheral bus, and a local bus using any of a variety of commercially available bus architectures. Interface adapters may connect to the system bus 1308 via a slot architecture. Example slot architectures may include without limitation Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and the like.

The system memory 1306 may include various types of computer-readable storage media in the form of one or more higher speed memory units, such as read-only memory (ROM), random-access memory (RAM), dynamic RAM (DRAM), Double-Data-Rate DRAM (DDRAM), synchronous DRAM (SDRAM), static RAM (SRAM), programmable ROM (PROM), erasable programmable ROM (EPROM), electrically erasable programmable ROM (EEPROM), flash memory (e.g., one or more flash arrays), polymer memory such as ferroelectric polymer memory, ovonic memory, phase change or ferroelectric memory, silicon-oxide-nitride-oxide-silicon (SONOS) memory, magnetic or optical cards, an array of devices such as Redundant Array of Independent Disks (RAID) drives, solid state memory devices (e.g., USB memory, solid state drives (SSD) and any other type of storage media suitable for storing information. In the illustrated embodiment shown in FIG. 13, the system memory 1306 can include non-volatile memory 1310 and/or volatile memory 1312. A basic input/output system (BIOS) can be stored in the non-volatile memory 1310.

The computer 1302 may include various types of computer-readable storage media in the form of one or more lower speed memory units, including an internal (or external) hard disk drive (HDD) 1314, a magnetic floppy disk drive (FDD) 1316 to read from or write to a removable magnetic disk 1318, and an optical disk drive 1320 to read from or write to a removable optical disk 1322 (e.g., a CD-ROM or DVD). The HDD 1314, FDD 1316 and optical disk drive 1320 can be connected to the system bus 1308 by a HDD interface 1324, an FDD interface 1326 and an optical drive interface 1328, respectively. The HDD interface 1324 for external drive implementations can include at least one or both of Universal Serial Bus (USB) and IEEE 994 interface technologies.

The drives and associated computer-readable media provide volatile and/or nonvolatile storage of data, data structures, computer-executable instructions, and so forth. For example, a number of program modules can be stored in the drives and memory units 1310, 1312, including an operating system 1330, one or more application programs 1332, other program modules 1334, and program data 1336. In one embodiment, the one or more application programs 1332, other program modules 1334, and program data 1336 can include, for example, the various applications and/or components of the computer-mediated reality system 100.

A user can enter commands and information into the computer 1302 through one or more wire/wireless input devices, for example, a keyboard 1338 and a pointing device, such as a mouse 1340. Other input devices may include microphones, infra-red (IR) remote controls, radio-frequency (RF) remote controls, game pads, stylus pens, card readers, dongles, finger print readers, gloves, graphics tablets, joysticks, keyboards, retina readers, touch screens (e.g., capacitive, resistive, etc.), trackballs, trackpads, sensors, styluses, and the like. These and other input devices are often connected to the processing unit 1304 through an input device interface 1342 that is coupled to the system bus 1308, but can be connected by other interfaces such as a parallel port, IEEE 994 serial port, a game port, a USB port, an IR interface, and so forth.

A monitor 1344 or other type of display device is also connected to the system bus 1308 via an interface, such as a video adaptor 1346. The monitor 1344 may be internal or external to the computer 1302. In addition to the monitor 1344, a computer typically includes other peripheral output devices, such as speakers, printers, and so forth.

The computer 1302 may operate in a networked environment using logical connections via wire and/or wireless communications to one or more remote computers, such as a remote computer 1348. The remote computer 1348 can be a workstation, a server computer, a router, a personal computer, portable computer, microprocessor-based entertainment appliance, a peer device or other common network node, and typically includes many or all of the elements described relative to the computer 1302, although, for purposes of brevity, only a memory/storage device 1350 is illustrated. The logical connections depicted include wire/wireless connectivity to a local area network (LAN) 1352 and/or larger networks, for example, a wide area network (WAN) 1354. Such LAN and WAN networking environments are commonplace in offices and companies, and facilitate enterprise-wide computer networks, such as intranets, all of which may connect to a global communications network, for example, the Internet.

When used in a LAN networking environment, the computer 1302 is connected to the LAN 1352 through a wire and/or wireless communication network interface or adaptor 1356. The adaptor 1356 can facilitate wire and/or wireless communications to the LAN 1352, which may also include a wireless access point disposed thereon for communicating with the wireless functionality of the adaptor 1356.

When used in a WAN networking environment, the computer 1302 can include a modem 1358, or is connected to a communications server on the WAN 1354, or has other means for establishing communications over the WAN 1354, such as by way of the Internet. The modem 1358, which can be internal or external and a wire and/or wireless device, connects to the system bus 1308 via the input device interface 1342. In a networked environment, program modules depicted relative to the computer 1302, or portions thereof, can be stored in the remote memory/storage device 1350. It will be appreciated that the network connections shown are exemplary and other means of establishing a communications link between the computers can be used.

The computer 1302 is operable to communicate with wire and wireless devices or entities using the IEEE 802 family of standards, such as wireless devices operatively disposed in wireless communication (e.g., IEEE 802.16 over-the-air modulation techniques). This includes at least Wi-Fi (or Wireless Fidelity), WiMax, and Bluetooth™ wireless technologies, among others. Thus, the communication can be a predefined structure as with a conventional network or simply an ad hoc communication between at least two devices. Wi-Fi networks use radio technologies called IEEE 802.11x (a, b, g, n, etc.) to provide secure, reliable, fast wireless connectivity. A Wi-Fi network can be used to connect computers to each other, to the Internet, and to wire networks (which use IEEE 802.3-related media and functions).

Figure 14:
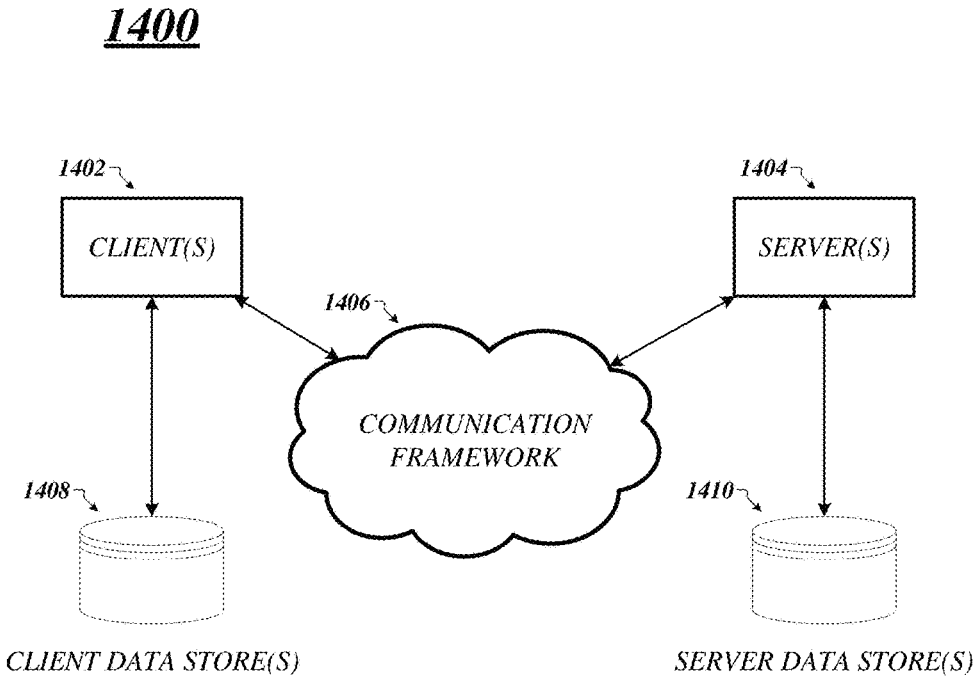
FIG. 14 illustrates an embodiment of a communication architecture.

FIG. 14 illustrates a block diagram of an exemplary communication architecture 1400 suitable for implementing various embodiments as previously described. The communication architecture 1400 includes various common communications elements, such as a transmitter, receiver, transceiver, radio, network interface, baseband processor, antenna, amplifiers, filters, power supplies, and so forth. The embodiments, however, are not limited to implementation by the communication architecture 1400.

As shown in FIG. 14, the communication architecture 1400 comprises includes one or more clients 1402 and servers 1404. The clients 1402 and the servers 1404 are operatively connected to one or more respective client data stores 1408 and server data stores 1410 that can be employed to store information local to the respective clients 1402 and servers 1404, such as cookies and/or associated contextual information. In various embodiments, any one of servers 1404 may implement one or more of logic flows or operations described herein, and storage medium 800 of FIG. 8 in conjunction with storage of data received from any one of clients 1402 on any of server data stores 1410.

The clients 1402 and the servers 1404 may communicate information between each other using a communication framework 1406. The communications framework 1406 may implement any well-known communications techniques and protocols. The communications framework 1406 may be implemented as a packet-switched network (e.g., public networks such as the Internet, private networks such as an enterprise intranet, and so forth), a circuit-switched network (e.g., the public switched telephone network), or a combination of a packet-switched network and a circuit-switched network (with suitable gateways and translators).

The communications framework 1406 may implement various network interfaces arranged to accept, communicate, and connect to a communications network. A network interface may be regarded as a specialized form of an input output interface. Network interfaces may employ connection protocols including without limitation direct connect, Ethernet (e.g., thick, thin, twisted pair 10/100/1900 Base T, and the like), token ring, wireless network interfaces, cellular network interfaces, IEEE 802.11a-x network interfaces, IEEE 802.16 network interfaces, IEEE 802.20 network interfaces, and the like. Further, multiple network interfaces may be used to engage with various communications network types. For example, multiple network interfaces may be employed to allow for the communication over broadcast, multicast, and unicast networks. Should processing requirements dictate a greater amount speed and capacity, distributed network controller architectures may similarly be employed to pool, load balance, and otherwise increase the communicative bandwidth required by clients 1402 and the servers 1404. A communications network may be any one and the combination of wired and/or wireless networks including without limitation a direct interconnection, a secured custom connection, a private network (e.g., an enterprise intranet), a public network (e.g., the Internet), a Personal Area Network (PAN), a Local Area Network (LAN), a Metropolitan Area Network (MAN), an Operating Missions as Nodes on the Internet (OMNI), a Wide Area Network (WAN), a wireless network, a cellular network, and other communications networks.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

One or more aspects of at least one embodiment may be implemented by representative instructions stored on a machine-readable medium which represents various logic within the processor, which when read by a machine causes the machine to fabricate logic to perform the techniques described herein. Such representations, known as "IP cores" may be stored on a tangible, machine readable medium and supplied to various customers or manufacturing facilities to load into the fabrication machines that actually make the logic or processor. Some embodiments may be implemented, for example, using a machine-readable medium or article which may store an instruction or a set of instructions that, if executed by a machine, may cause the machine to perform a method and/or operations in accordance with the embodiments. Such a machine may include, for example, any suitable processing platform, computing platform, computing device, processing device, computing system, processing system, computer, processor, or the like, and may be implemented using any suitable combination of hardware and/or software. The machine-readable medium or article may include, for example, any suitable type of memory unit, memory device, memory article, memory medium, storage device, storage article, storage medium and/or storage unit, for example, memory, removable or non-removable media, erasable or non-erasable media, writeable or re-writeable media, digital or analog media, hard disk, floppy disk, Compact Disk Read Only Memory (CD-ROM), Compact Disk Recordable (CD-R), Compact Disk Rewriteable (CD-RW), optical disk, magnetic media, magneto-optical media, removable memory cards or disks, various types of Digital Versatile Disk (DVD), a tape, a cassette, or the like. The instructions may include any suitable type of code, such as source code, compiled code, interpreted code, executable code, static code, dynamic code, encrypted code, and the like, implemented using any suitable high-level, low-level, object-oriented, visual, compiled and/or interpreted programming language.

The following examples pertain to further embodiments, from which numerous permutations and configurations will be apparent.

Example 1 is an apparatus comprising a memory and logic, at least a portion of the logic implemented in circuitry coupled to the memory, the logic to accumulate pixel usage data for an organic light emitting diode (OLED) display to store in the memory, receive image data for an image to be displayed, generate a pixel shifting pattern for the image based on the accumulated pixel usage data and the image data for the image, apply the pixel shifting pattern to the image to generate modified image data, and output the modified image data for display.

Example 2 is an extension of Example 1 or any other example disclosed herein, the accumulated pixel usage data based on prior displayed images.

Example 3 is an extension of Example 1 or any other example disclosed herein, the accumulated pixel usage data indicating an age of each pixel of the OLED display.

Example 4 is an extension of Example 1 or any other example disclosed herein, the accumulated pixel usage data indicating a total amount of use of each pixel of the OLED display.

Example 5 is an extension of Example 1 or any other example disclosed herein, the accumulated pixel usage data indicating a luminance level of each pixel of the OLED display.

Example 6 is an extension of Example 1 or any other example disclosed herein, the accumulated pixel usage data indicating a brightness level of each pixel of the OLED display.

Example 7 is an extension of Example 1 or any other example disclosed herein, the logic to generate a usage profile for each pixel of the OLED display based on the accumulated pixel usage data.

Example 8 is an extension of Example 7 or any other example disclosed herein, the usage profile to include a damage signature for the OLED display.

Example 9 is an extension of Example 8 or any other example disclosed herein, the damage signature to indicate a level of damage incurred by one or more regions of the OLED display.

Example 10 is an extension of Example 9 or any other example disclosed herein, the level of damage specified by a priority level assigned to each region of the OLED display.

Example 11 is an extension of Example 10 or any other example disclosed herein, the logic to assign a relatively low priority level to regions with relatively high damage and to assign a relatively high priority level to regions with relatively low damage.

Example 12 is an extension of Example 10 or any other example disclosed herein, the logic to assign a relatively low priority level to regions characterized by relatively high aging and to assign a relatively high priority level to regions characterized by relatively low aging.

Example 13 is an extension of Example 10 or any other example disclosed herein, the logic to assign a relatively low priority level to regions characterized by relatively higher brightness and to assign a relatively high priority level to regions characterized by relatively lower brightness.

Example 14 is an extension of Example 1 or any other example disclosed herein, the pixel shifting pattern to include a number of steps, each step specifying a location to display the image on the OLED display relative to a center of the image and a corresponding amount of time the image is to occupy the specified location.

Example 15 is an extension of Example 14 or any other example disclosed herein, the location specified by a horizontal pixel position and a vertical pixel position.

Example 16 is an extension of Example 14 or any other example disclosed herein, the amount of time indicated by a fraction of a frame rate of the OLED display.

Example 17 is an extension of Example 14 or any other example disclosed herein, the pixel shifting pattern to include one or more of an adjustment to the amount of time and an adjustment to the specified location based on the accumulated pixel usage data and the image data of the image.

Example 18 is an extension of Example 14 or any other example disclosed herein, the pixel shifting pattern to include a time weighted factor to adjust the amount of time the image is to occupy the specified location.

Example 19 is an extension of Example 18 or any other example disclosed herein, the time weighted factor to be set to zero to indicate a specified location is to be skipped.

Example 20 is an extension of Example 14 or any other example disclosed herein, the logic to modify the pixel shifting pattern periodically.

Example 21 is an extension of Example 14 or any other example disclosed herein, the logic to parse the OLED display into two or more non-overlapping segments based on the accumulated pixel usage data.

Example 22 is an extension of Example 21 or any other example disclosed herein, the logic to generate different pixel shifting patterns for each non-overlapping segment.

Example 23 is an extension of Example 1 or any other example disclosed herein, the pixel shifting pattern to delay an onset of burn-in for the OLED display.

Example 24 is a method comprising accumulating pixel usage data for an organic light emitting diode (OLED) display, receiving image data for an image to be displayed, generating a pixel shifting pattern for the image based on the accumulated pixel usage data and the image data for the image, applying the pixel shifting pattern to the image to generate modified image data, and outputting the modified image data for display.

Example 25 is an extension of Example 24 or any other example disclosed herein, the pixel usage data based on prior displayed images.

Example 26 is an extension of Example 24 or any other example disclosed herein, the pixel usage data indicating an age of each pixel of the OLED display.

Example 27 is an extension of Example 24 or any other example disclosed herein, the pixel usage data indicating a total amount of use of each pixel of the OLED display.

Example 28 is an extension of Example 24 or any other example disclosed herein, the pixel usage data indicating a luminance level of each pixel of the OLED display.

Example 29 is an extension of Example 24 or any other example disclosed herein, the pixel usage data indicating a brightness level of each pixel of the OLED display.

Example 30 is an extension of Example 24 or any other example disclosed herein, generating a usage profile for each pixel of the OLED display based on the pixel usage data.

Example 31 is an extension of Example 30 or any other example disclosed herein, including a damage signature for the OLED display in the usage profile.

Example 32 is an extension of Example 2314 or any other example disclosed herein, indicating a level of damage incurred by one or more regions of the OLED display in the damage profile.

Example 33 is an extension of Example 32 or any other example disclosed herein, indicating the level of damage by specifying a priority level assigned to each region of the OLED display.

Example 34 is an extension of Example 33 or any other example disclosed herein, assigning a relatively low priority level to regions with relatively high damage and assigning a relatively high priority level to regions with relatively low damage.

Example 35 is an extension of Example 33 or any other example disclosed herein, assigning a relatively low priority level to regions characterized by relatively high aging and assigning a relatively high priority level to regions characterized by relatively low aging.

Example 36 is an extension of Example 33 or any other example disclosed herein, assigning a relatively low priority level to regions characterized by relatively higher brightness and assigning a relatively high priority level to regions characterized by relatively lower brightness.

Example 37 is an extension of Example 24 or any other example disclosed herein, the pixel shifting pattern to include a number of steps, each step specifying a location to display the image on the OLED display relative to a center of the image and a corresponding amount of time the image is to occupy the specified location.

Example 38 is an extension of Example 37 or any other example disclosed herein, specifying the location by a horizontal pixel position and a vertical pixel position.

Example 39 is an extension of Example 37 or any other example disclosed herein, indicating the amount of time by a fraction of a frame rate of the OLED display.

Example 40 is an extension of Example 37 or any other example disclosed herein, the pixel shifting pattern to include one or more of an adjustment to the amount of time and an adjustment to the specified location based on the accumulated pixel usage data and the image data of the image.

Example 41 is an extension of Example 37 or any other example disclosed herein, the pixel shifting pattern to include a time weighted factor to adjust the amount of time the image is to occupy the specified location.

Example 42 is an extension of Example 41 or any other example disclosed herein, setting the time weighted factor to be zero to indicate a specified location is to be skipped.

Example 43 is an extension of Example 37 or any other example disclosed herein, modifying the pixel shifting pattern periodically.

Example 44 is an extension of Example 37 or any other example disclosed herein, parsing the OLED display into two or more non-overlapping segments based on the accumulated pixel usage data.

Example 45 is an extension of Example 44 or any other example disclosed herein, generating different pixel shifting patterns for each non-overlapping segment.

Example 46 is an extension of Example 24 or any other example disclosed herein, the pixel shifting pattern to delay an onset of burn-in for the OLED display.

Example 47 is at least one non-transitory computer-readable storage medium comprising a set of instructions that, in response to being executed on a computing device, cause the computing device to accumulate pixel usage data for an organic light emitting diode (OLED) display to store in the memory, receive image data for an image to be displayed, generate a pixel shifting pattern for the image based on the accumulated pixel usage data and the image data for the image, apply the pixel shifting pattern to the image to generate modified image data, and output the modified image data for display.

Example 48 is an extension of Example 47 or any other example disclosed herein, comprising instructions that, in response to being executed on the computing device, cause the computing device to accumulate pixel usage data based on prior displayed images.

Example 49 is an extension of Example 47 or any other example disclosed herein, comprising instructions that, in response to being executed on the computing device, cause the computing device to accumulate pixel usage data indicating an age of each pixel of the OLED display.

Example 50 is an extension of Example 47 or any other example disclosed herein, comprising instructions that, in response to being executed on the computing device, cause the computing device to accumulate pixel usage data indicating a total amount of use of each pixel of the OLED display.

Example 51 is an extension of Example 47 or any other example disclosed herein, comprising instructions that, in response to being executed on the computing device, cause the computing device to accumulate pixel usage data indicating a luminance level of each pixel of the OLED display.

Example 52 is an extension of Example 47 or any other example disclosed herein, comprising instructions that, in response to being executed on the computing device, cause the computing device to accumulate pixel usage data indicating a brightness level of each pixel of the OLED display.

Example 53 is an extension of Example 47 or any other example disclosed herein, comprising instructions that, in response to being executed on the computing device, cause the computing device to generate a usage profile for each pixel of the OLED display based on the accumulated pixel usage data.

Example 54 is an extension of Example 54 or any other example disclosed herein, comprising instructions that, in response to being executed on the computing device, cause the computing device to generate the usage profile to include a damage signature for the OLED display.

Example 55 is an extension of Example 54 or any other example disclosed herein, cause the computing device to include the damage signature to indicate a level of damage incurred by one or more regions of the OLED display.

Example 56 is an extension of Example 55 or any other example disclosed herein, comprising instructions that, in response to being executed on the computing device, cause the computing device to specify the level of damage by a priority level assigned to each region of the OLED display.

Example 57 is an extension of Example 56 or any other example disclosed herein, comprising instructions that, in response to being executed on the computing device, cause the computing device to assign a relatively low priority level to regions with relatively high damage and to assign a relatively high priority level to regions with relatively low damage.

Example 58 is an extension of Example 56 or any other example disclosed herein, comprising instructions that, in response to being executed on the computing device, cause the computing device to assign a relatively low priority level to regions characterized by relatively high aging and to assign a relatively high priority level to regions characterized by relatively low aging.

Example 59 is an extension of Example 56 or any other example disclosed herein, comprising instructions that, in response to being executed on the computing device, cause the computing device to assign a relatively low priority level to regions characterized by relatively higher brightness and to assign a relatively high priority level to regions characterized by relatively lower brightness.

Example 60 is an extension of Example 47 or any other example disclosed herein, comprising instructions that, in response to being executed on the computing device, cause the computing device to generate the pixel shifting pattern to include a number of steps, each step specifying a location to display the image on the OLED display relative to a center of the image and a corresponding amount of time the image is to occupy the specified location.

Example 61 is an extension of Example 60 or any other example disclosed herein, comprising instructions that, in response to being executed on the computing device, cause the computing device to specify the location by a horizontal pixel position and a vertical pixel position.

Example 62 is an extension of Example 60 or any other example disclosed herein, comprising instructions that, in response to being executed on the computing device, cause the computing device to indicate the amount of time by a fraction of a frame rate of the OLED display.

Example 63 is an extension of Example 60 or any other example disclosed herein, comprising instructions that, in response to being executed on the computing device, cause the computing device to generate the pixel shifting pattern to include one or more of an adjustment to the amount of time and an adjustment to the specified location based on the accumulated pixel usage data and the image data of the image.

Example 64 is an extension of Example 47 or any other example disclosed herein, comprising instructions that, in response to being executed on the computing device, cause the computing device to generate the pixel shifting pattern to include a time weighted factor to adjust the amount of time the image is to occupy the specified location.

Example 65 is an extension of Example 64 or any other example disclosed herein, comprising instructions that, in response to being executed on the computing device, cause the computing device to set the time weighted factor to be zero to indicate a specified location is to be skipped.

Example 66 is an extension of Example 60 or any other example disclosed herein, comprising instructions that, in response to being executed on the computing device, cause the computing device to modify the pixel shifting pattern periodically.

Example 67 is an extension of Example 60 or any other example disclosed herein, comprising instructions that, in response to being executed on the computing device, cause the computing device to parse the OLED display into two or more non-overlapping segments based on the accumulated pixel usage data.

Example 68 is an extension of Example 67 or any other example disclosed herein, comprising instructions that, in response to being executed on the computing device, cause the computing device to generate different pixel shifting patterns for each non-overlapping segment.

Example 69 is an extension of Example 47 or any other example disclosed herein, comprising instructions that, in response to being executed on the computing device, cause the computing device to generate the pixel shifting pattern to delay an onset of burn-in for the OLED display.

Each of the foregoing examples can be extended to any self-emissive and/or pixel-based display including, for example, plasma displays, micro LED displays, and quantum dot LED (QLED) displays as well as liquid crystal displays (LCDs).

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future filed applications claiming priority to this application may claim the disclosed subject matter in a different manner, and may generally include any set of one or more limitations as variously disclosed or otherwise demonstrated herein.

Numerous specific details have been set forth herein to provide a thorough understanding of the embodiments. It will be understood by those skilled in the art, however, that the embodiments may be practiced without these specific details. In other instances, well-known operations, components, and circuits have not been described in detail so as not to obscure the embodiments. It can be appreciated that the specific structural and functional details disclosed herein may be representative and do not necessarily limit the scope of the embodiments.

Some embodiments may be described using the expression "coupled" and "connected" along with their derivatives. These terms are not intended as synonyms for each other. For example, some embodiments may be described using the terms "connected" and/or "coupled" to indicate that two or more elements are in direct physical or electrical contact with each other. The term "coupled," however, may also mean that two or more elements are not in direct contact with each other, but yet still co-operate or interact with each other.

Unless specifically stated otherwise, it may be appreciated that terms such as "processing," "computing," "calculating," "determining," or the like, refer to the action and/or processes of a computer or computing system, or similar electronic computing device, that manipulates and/or transforms data represented as physical quantities (e.g., electronic) within the computing system's registers and/or memories into other data similarly represented as physical quantities within the computing system's memories, registers or other such information storage, transmission or display devices. The embodiments are not limited in this context.

It should be noted that the methods described herein do not have to be executed in the order described, or in any particular order. Moreover, various activities described with respect to the methods identified herein can be executed in serial or parallel fashion.

Although specific embodiments have been illustrated and described herein, it should be appreciated that any arrangement calculated to achieve the same purpose may be substituted for the specific embodiments shown. This disclosure is intended to cover any and all adaptations or variations of various embodiments. It is to be understood that the above description has been made in an illustrative fashion, and not a restrictive one. Combinations of the above embodiments, and other embodiments not specifically described herein will be apparent to those of skill in the art upon reviewing the above description. Thus, the scope of various embodiments includes any other applications in which the above compositions, structures, and methods are used.

It is emphasized that the Abstract of the Disclosure is provided to comply with 37 C.F.R. § 1.72(b), requiring an abstract that will allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separate preferred embodiment. In the appended claims, the terms "including" and "in which" are used as the plain-English equivalents of the respective terms "comprising" and "wherein," respectively. Moreover, the terms "first," "second," and "third," etc. are used merely as labels, and are not intended to impose numerical requirements on their objects.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An apparatus, comprising:

a memory; and logic, at least a portion of the logic implemented in circuitry coupled to the memory, the logic to:

accumulate pixel usage data for an organic light emitting diode (OLED) display to store in the memory;

receive image data for an image to be displayed;

determine a pixel usage distribution for the image based on the image data;

generate a pixel shifting pattern for the image based on the accumulated pixel usage data and the pixel usage distribution, the pixel shifting pattern to include a number of steps, each step specifying a location to display the image on the OLED display relative to a center of the image and a corresponding amount of time the image is to occupy the specified location, the amount of time based on a time weighted factor determined based in part on the accumulated pixel usage data and the pixel usage distribution, the time weighted factor for at least one of the steps to be set to zero to indicate the specified location for the at least one of the steps is to be skipped;

apply the pixel shifting pattern to the image to generate modified image data; and output the modified image data for display.

2. The apparatus of claim 1, the accumulated pixel usage data based on prior displayed images.

3. The apparatus of claim 1, the logic to generate a damage signature for the OLED display based on the accumulated pixel usage data, the damage signature to indicate a level of damage incurred by one or more regions of the OLED display.

4. The apparatus of claim 3, the level of damage specified by a priority level assigned to each region of the OLED display, the logic to assign a relatively low priority level to regions with relatively high damage or aging and to assign a relatively high priority level to regions with relatively low damage or aging.

5. The apparatus of claim 1, the location specified by a horizontal pixel position and a vertical pixel position.

6. The apparatus of claim 1, the pixel shifting pattern to include one or more of an adjustment to the amount of time and an adjustment to the specified location based on the accumulated pixel usage data and the image data of the image.

7. The apparatus of claim 1, the logic to modify the pixel shifting pattern periodically.

8. The apparatus of claim 1, the logic to parse the OLED display into two or more non-overlapping segments based on the accumulated pixel usage data and to generate different pixel shifting patterns for each non-overlapping segment.

9. A method, comprising:

accumulating pixel usage data for an organic light emitting diode (OLED) display;

receiving image data for an image to be displayed;

determining a pixel usage distribution for the image based on the image data;

generating a pixel shifting pattern for the image based on the accumulated pixel usage data and the pixel usage distribution, the pixel shifting pattern to include a number of steps, each step specifying a location to display the image on the OLED display relative to a center of the image and a corresponding amount of time the image is to occupy the specified location, the amount of time based on a time weighted factor determined based in part on the accumulated pixel usage data and the pixel usage distribution, the time weighted factor for at least one of the steps to be set to zero to indicate the specified location for the at least one of the steps is to be skipped;

applying the pixel shifting pattern to the image to generate modified image data; and outputting the modified image data for display.

10. The method of claim 9, the pixel shifting pattern to delay an onset of burn-in for the OLED display.

11. At least one non-transitory machine readable medium comprising instructions that in response to being executed by a processor coupled to a display, cause the processor to:

accumulate pixel usage data for the display;

receive image data for an image to be displayed on the display;

determine a pixel usage distribution for the image based on the image data;

generate a pixel shifting pattern for the image based on the accumulated pixel usage data and the pixel usage distribution, the pixel shifting pattern to include a number of steps, each step specifying a location to display the image on the display relative to a center of the image and a corresponding amount of time the image is to occupy the specified location, the amount of time based on a time weighted factor determined based in part on the accumulated pixel usage data and the pixel usage distribution, the time weighted factor for at least one of the steps to be set to zero to indicate the specified location for the at least one of the steps is to be skipped;

apply the pixel shifting pattern to the image to generate modified image data; and output the modified image data to the display.

12. The at least one non-transitory machine readable medium of claim 11, comprising instructions to also cause the processor to:

parse the display into two or more non-overlapping segments based on the accumulated pixel usage data; and generate different pixel shifting patterns for each non-overlapping segment.

* * * * *